US011003116B2

(12) United States Patent
Isono

(10) Patent No.: US 11,003,116 B2
(45) Date of Patent: May 11, 2021

(54) FIXING UNIT AND IMAGE FORMING APPARATUS

(71) Applicant: CANON KABUSHIKI KAISHA, Tokyo (JP)

(72) Inventor: Aoji Isono, Naka-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/910,379

(22) Filed: Jun. 24, 2020

(65) Prior Publication Data

US 2021/0003948 A1 Jan. 7, 2021

(30) Foreign Application Priority Data

Jul. 5, 2019 (JP) ..... JP2019-125854

(51) Int. Cl.
*G03G 15/20* (2006.01)

(52) U.S. Cl.
CPC ..... *G03G 15/2039* (2013.01); *G03G 15/2053* (2013.01); *G03G 2215/2003* (2013.01)

(58) Field of Classification Search
CPC ..... G03G 15/2039; G03G 15/2053; G03G 2215/2003
See application file for complete search history.

(56) References Cited

U.S. PATENT DOCUMENTS 7,693,439 B2 4/2010 Seo et al.
9,442,440 B2 9/2016 Hashiguchi et al.
9,501,010 B2 11/2016 Itoh et al.
9,547,264 B2 1/2017 Kurata et al.
2010/0310267 A1* 12/2010 Shimura ..... G03G 15/80 399/69
2016/0026127 A1* 1/2016 Hayasaki ..... G03G 15/2042 399/69
2020/0103795 A1 4/2020 Isono et al.
2020/0103800 A1 4/2020 Nishizawa et al.

FOREIGN PATENT DOCUMENTS

JP 2007-316407 A 12/2007
JP 2008-287224 A 11/2008
JP 2014-102307 A 6/2014
JP 2016-24367 A 2/2016
JP 2016-29460 A 3/2016

* cited by examiner

*Primary Examiner* — Clayton E. LaBalle
*Assistant Examiner* — Michael A Harrison
(74) *Attorney, Agent, or Firm* — Venable LLP

(57) ABSTRACT

A fixing unit includes a rotary member, a magnetic core, a coil, a converter device, a temperature detection unit, and a controller. A conductive layer of the rotary member is heated by induction heating. The controller causes the converter device to output a cyclic waveform in which a first waveform and a second waveform appear. The first waveform is a waveform in which pulses having a constant cycle are successively output for a first output period and output of the pulses is paused for a first pause period after the first output period. The second waveform is a waveform in which the first waveform is repeatedly output for a second output period and output of the first waveform is paused for a second pause period after the second output period. The cyclic waveform is a waveform in which the second waveform is cyclically repeated as a repetition unit.

15 Claims, 14 Drawing Sheets

FIXING UNIT AND IMAGE FORMING APPARATUS

BACKGROUND OF THE INVENTION

Field of the Invention

The present invention relates to a fixing unit fixing a toner image onto a recording material and an image forming apparatus including the fixing unit.

Description of the Related Art

In an image forming apparatus based on an electrophotographic system, there is an induction heating type fixing unit fixing a toner image onto a recording material by heating and melting the toner image transferred to the recording material. The induction heating type fixing unit generates an alternating magnetic field by applying an AC voltage to a coil, and heats a rotary member having a conductive layer according to the electromagnetic induction principle.

Japanese Patent Application Laid-Open Publication No. 2016-29460 discloses a technique in which a heat generation distribution corresponding to a size of a recording material is obtained by switching frequencies of a high frequency voltage output from a converter device by using the property that a distribution of a heating value of a fixing sleeve in a longitudinal direction changes due to a frequency of an AC voltage applied to a coil. Japanese Patent Application Laid-Open Publication No. 2016-24367 discloses a converter device including an inverter circuit applying an AC voltage to a coil at a predetermined frequency at which a heat generation distribution corresponding to a size of a recording material can be obtained, and a step-down converter capable of controlling a voltage to be supplied to the inverter circuit.

In the device disclosed in Japanese Patent Application Laid-Open Publication No. 2016-24367, the step-down converter controls a voltage to be supplied to the inverter circuit, and thus it is possible to control a heating value of the whole fixing sleeve while maintaining a heat generation distribution. However, circuit elements forming the step-down converter are disposed in the converter device, and thus there is room for improvement in cost increase and complexity of the device. A technique of changing a temporal density of high frequency pulses output from a converter device has been examined as a method of controlling a heating value with a simpler configuration, but it has been found that there are cases where an unpleasant mosquito sound is generated, or vibration in a rotary member influencing image quality is generated.

SUMMARY OF THE INVENTION

The present invention provides a fixing unit and an image forming apparatus including the same capable of controlling a heating value with a simple configuration and also reducing a problem due to a specific frequency component being included in a drive voltage.

According to one aspect of the invention, a fixing unit includes: a rotary member that is tubular and includes a conductive layer; a magnetic core inserted in the rotary member and extending in a longitudinal direction of the rotary member; a coil wound around an outer circumference of the magnetic core; a converter device configured to apply an AC voltage to the coil; a temperature detection unit configured to detect a temperature of the rotary member; and a controller configured to control the converter device based on a detection result of the temperature detection unit such that the conductive layer is heated by induction heating and a toner image on a recording material coming into contact with the rotary member is heated to be fixed onto the recording material. The controller causes the converter device to output a cyclic waveform in which a first waveform and a second waveform appear. The first waveform is a waveform in which pulses having a constant cycle are successively output for a first output period and output of the pulses is paused for a first pause period after the first output period. The second waveform is a waveform in which the first waveform is repeatedly output for a second output period and output of the first waveform is paused for a second pause period after the second output period. The cyclic waveform is a waveform in which the second waveform is cyclically repeated as a repetition unit.

Further features of the present invention will become apparent from the following description of exemplary embodiments with reference to the attached drawings.

DESCRIPTION OF THE EMBODIMENTS

Hereinafter, exemplary embodiments of the present invention will be described with reference to the drawings.

Example 1

1. Outline of Image Forming Apparatus

Figure 1:
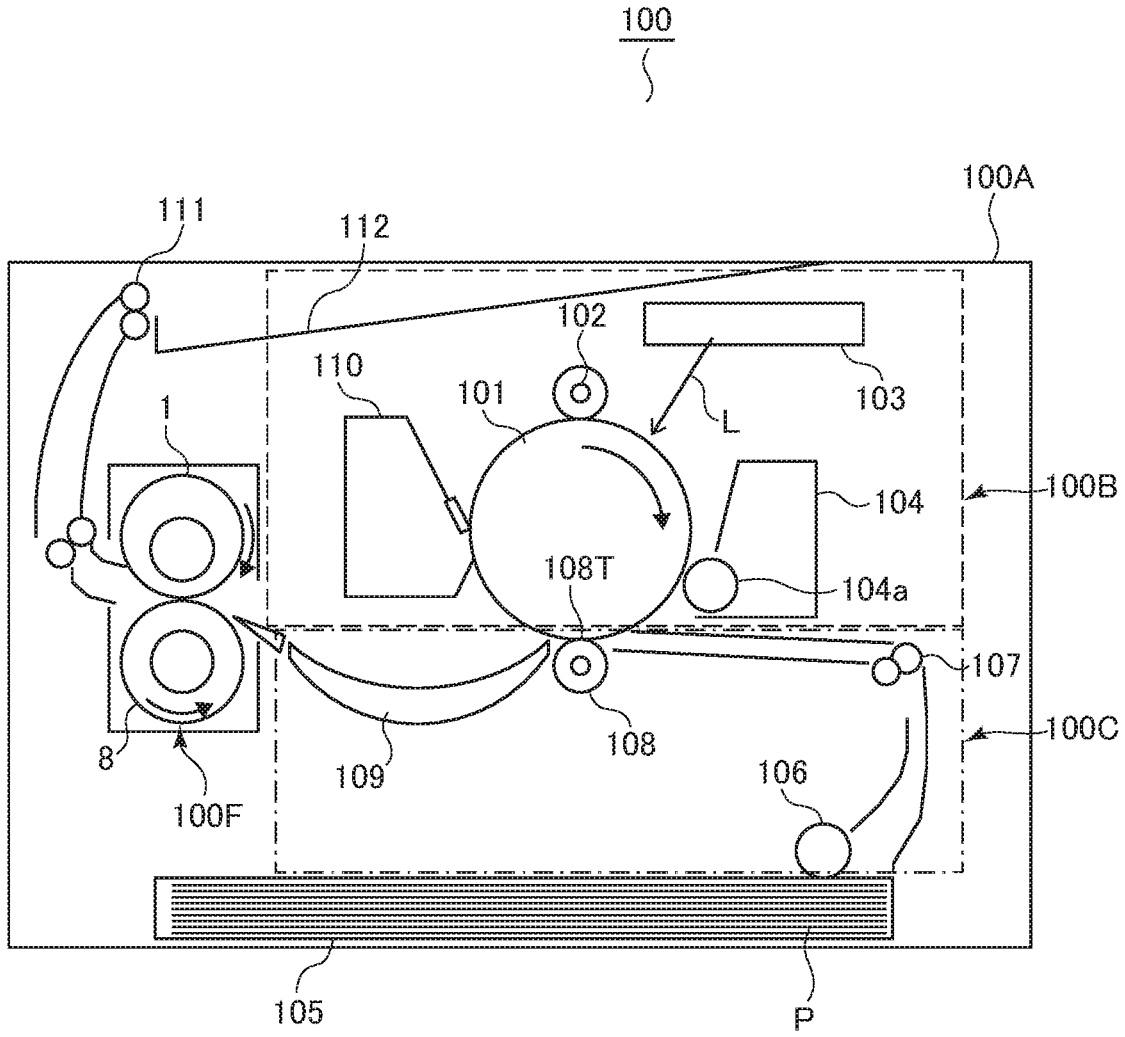
FIG. 1 is a schematic diagram illustrating an image forming apparatus of Example 1.

FIG. 1 is a schematic configuration diagram illustrating a fixing unit 100F (image heating unit) of a first embodiment (i.e., Example 1) and an image forming apparatus 100 including the same. The image forming apparatus 100 is a laser beam printer based on an electrophotographic system. The image forming apparatus 100 roughly includes an image forming unit 100B forming a toner image on a recording material, a recording material conveying portion 100C conveying a recording material, the fixing unit 100F performing a process of fixing a toner image, and a casing (or, printer body) 100A accommodating the constituent elements.

The image forming unit 100B creates a toner image according to an electrophotographic process by using a photosensitive drum 101 serving as an image bearing member. That is, the photosensitive drum 101 is rotatably driven in a clockwise direction indicated by an arrow in FIG. 1 at a predetermined process speed (peripheral speed). A surface of the photosensitive drum 101 is uniformly charged with a predetermined polarity potential by a charging roller 102 during rotation thereof. A laser beam scanner 103 serving as an image exposure unit outputs laser light L that is modulated in ON and OFF forms corresponding to a digital pixel signal being input from an external apparatus such as a personal computer, and subjects the charged surface of the photosensitive drum 101 to scanning exposure. Electric charge is removed from the surface of the photosensitive drum 101 due to the scanning exposure, and thus an electrostatic latent image corresponding to image information is formed on the surface of the photosensitive drum 101. A developing unit 104 supplies toner serving as a developer to the photosensitive drum 101 by a developing roller 104*a*, and thus develops the electrostatic latent image into a toner image.

A recording material conveying portion 100C conveys a recording material P inside the image forming apparatus, and supplies the recording material to the image forming unit 100B. The recording material P may include various sheet materials, for example, a sheet such as plain paper or cardboard, a plastic film such as an overhead projector sheet, a surface-treated sheet material such as coated paper, cloth, and a sheet with a special shape such as an envelope or an index sheet.

The recording materials P are stacked and stored in a feed cassette 105. In a case where a controller outputs a feed start signal, a feed roller 106 is driven, and thus the recording materials P in the feed cassette 105 are separated one by one to be fed. The recording material P is introduced into a transfer portion 108T (a nip portion at which the photosensitive drum 101 and a transfer roller 108 driven to be rotated in contact therewith come into contact) via a registration roller 107. In other words, an operation of the conveyed recording material P is controlled by the registration roller 107 such that an end part of a toner image born on the photosensitive drum 101 and an end part of the recording material P simultaneously reach the transfer portion 108T.

The recording material P having reached the transfer portion 108T is nipped and conveyed between the photosensitive drum 101 and the transfer roller 108, and, during that time, a transfer voltage (transfer bias) with a reverse polarity to a normal charge polarity of toner is applied to the transfer roller 108 from a transfer bias applying power source. Consequently, in the transfer portion 108T, the toner is electrostatically transferred onto the surface of the recording material P from the surface of the photosensitive drum 101, and thus a toner image is transferred onto the recording material. The recording material P having passed through the transfer portion 108T is separated from the surface of the photosensitive drum 101 to be guided to a conveyance guide 109, and is then introduced into the fixing unit 100F. As will be described later in detail, the fixing unit 100F performs a thermal fixation process on the toner image on the recording material. On the other hand, deposit such as residual toner or paper dust is removed from the surface of the photosensitive drum 101 having passed through the transfer portion 108T by a cleaning unit 110 such that the surface thereof is cleaned to be successively provided to a toner image creation process. The recording material P having passed through the fixing unit 100F is discharged to a sheet discharge tray 112 from a sheet discharge port 111.

2. Outline of Fixing Unit 100F

Figure 2:
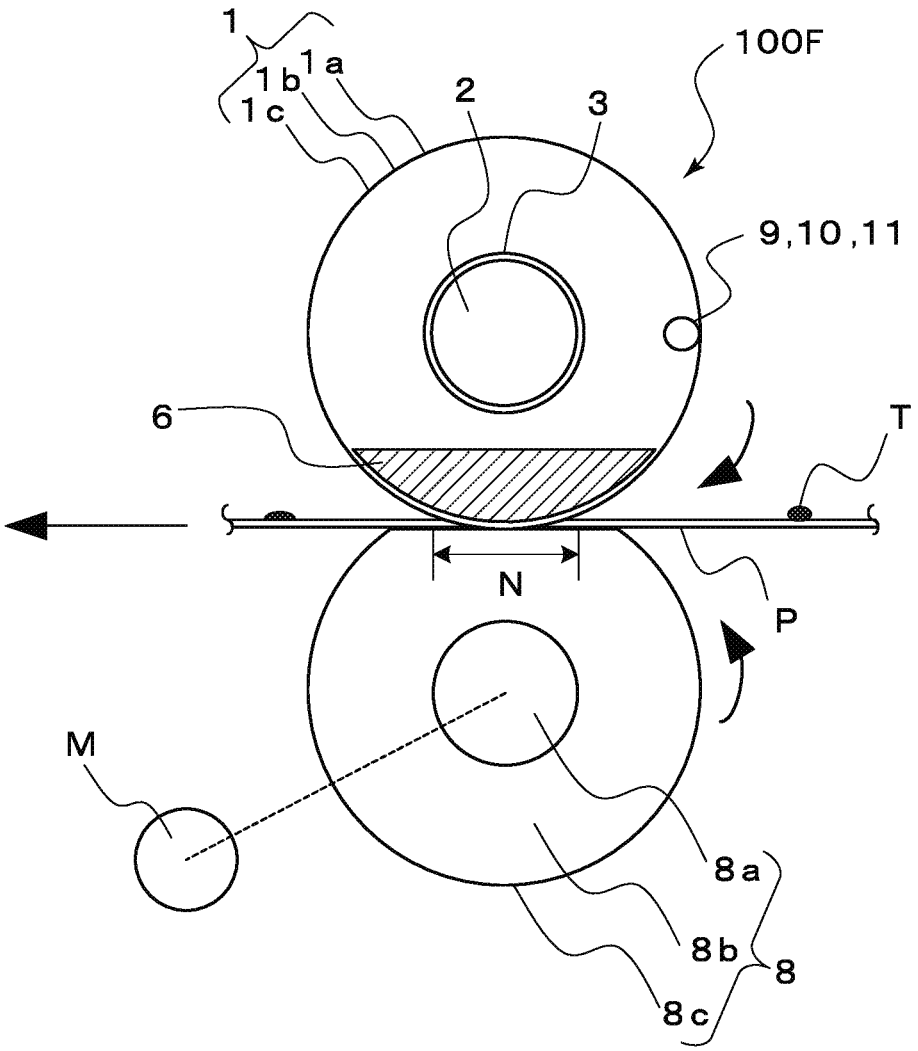
FIG. 2 is a schematic diagram illustrating a cross section of a fixing unit of Example 1.
Figure 3:
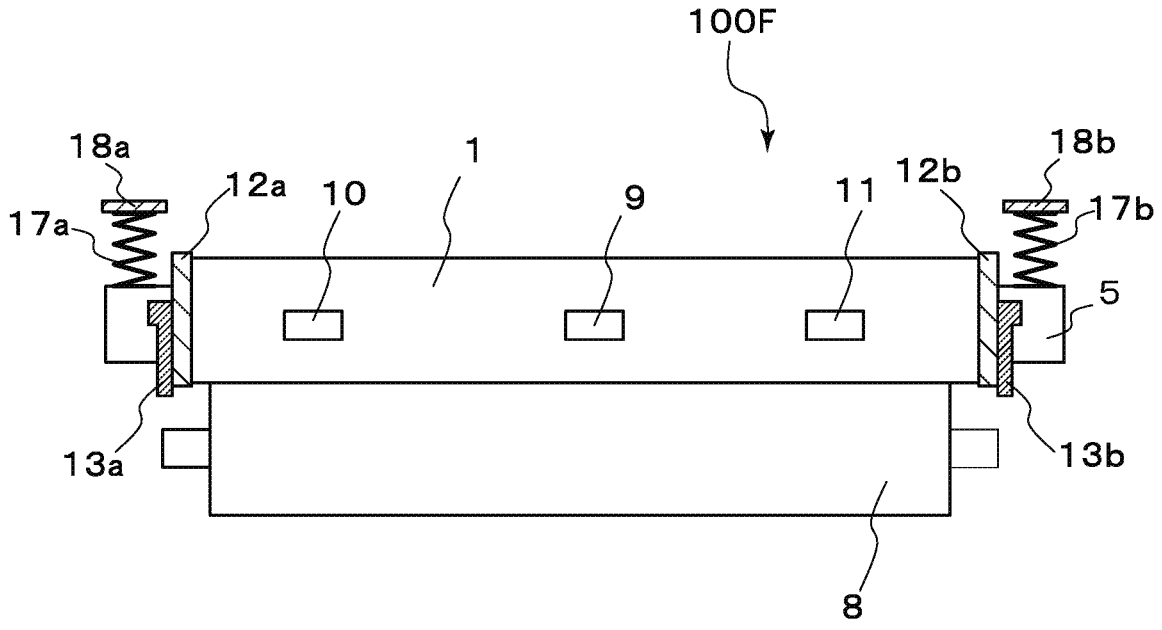
FIG. 3 is a schematic diagram in which the fixing unit of Example 1 is viewed from a side surface.
Figure 4:
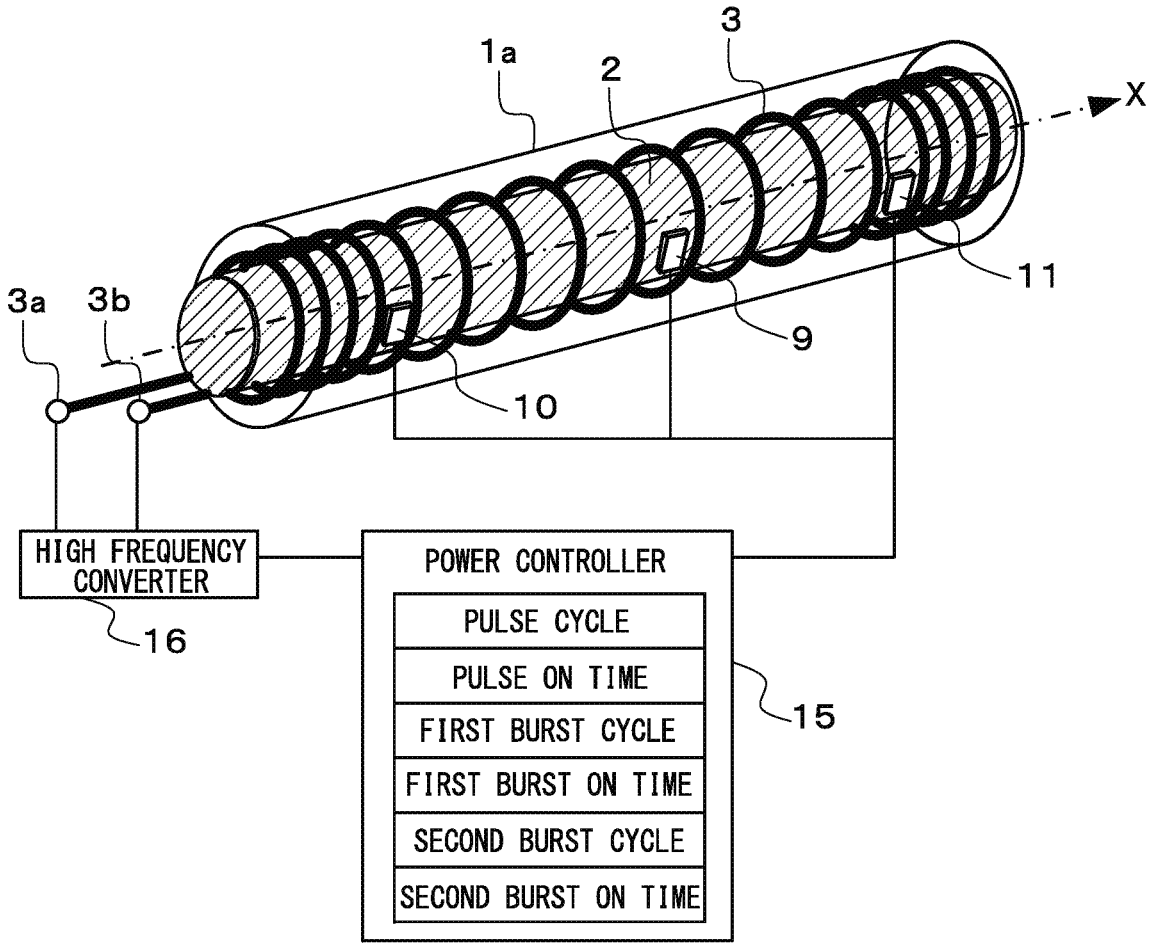
FIG. 4 is a perspective view illustrating a part of the fixing unit of Example 1.

The fixing unit 100F of the present embodiment is an induction heating type unit heating a heating target according to the electromagnetic induction principle. FIG. 2 is a schematic cross-sectional view illustrating the fixing unit 100F, FIG. 3 is a schematic diagram in which the fixing unit 100F is viewed from a side surface, and FIG. 4 is a schematic diagram illustrating an internal configuration of the fixing unit 100F. None of FIGS. 2 to 4 illustrate the casing or the like serving as an outer shell of the fixing unit 100F.

As illustrated in FIGS. 2 and 3, the fixing unit 100F includes a fixing sleeve 1 having a conductive layer, a pressing roller 8 serving as a facing rotary member facing the fixing sleeve 1, and a guide member 6 guiding rotation of the fixing sleeve 1. The fixing sleeve 1 that is an example of a tubular rotary member is formed of an endless film. The guide member 6 is a nip portion forming member forming a nip portion (fixing nip N) that brings the fixing sleeve 1 into contact with the pressing roller 8 such that the pressing roller 8 and the fixing sleeve 1 nip and convey the recording material P.

Hereinafter, a "longitudinal direction" of members (the fixing sleeve 1, the pressing roller 8, and the guide member 6) forming the fixing unit 100F is assumed to indicate a direction (a width direction of the recording material P) orthogonal to a conveyance direction and a thickness direction of the recording material P at the fixing nip N.

As illustrated in FIG. 4, the fixing unit 100F further includes an energizing coil 3, a magnetic core 2, and a high frequency converter 16. The energizing coil 3 is inserted into the fixing sleeve 1, and is wound in a spiral shape in a longitudinal direction (a rotational axial direction X in FIG. 4) of the fixing sleeve 1. The energizing coil 3 functions as a magnetic field generation portion that causes an induction current in the conductive layer of the fixing sleeve 1 in a circumferential direction by generating an alternating magnetic field when an AC current flows therethrough. The energizing coil 3 is wound around an outer circumference of the magnetic core 2 serving as a magnetic core.

The high frequency converter 16 that is a power source unit of the present embodiment is controlled by a power controller 15 to generate a high frequency voltage by using power supplied from a commercial power source, and applies the high frequency voltage to the energizing coil 3. As will be described later, the high frequency converter 16 outputs a cyclic waveform including burst pulses. Here, the burst pulses indicate pulses being output through a so-called intermittent operation in which pulses are output for a first output period, and output of a pulse is paused for a first pause period. Regarding a burst cycle, for example, a cycle composed of one first output period and one first pause period will be referred to as a "first burst cycle". The power controller 15 controls a heat generation distribution and a heating value of the fixing sleeve 1 by changing a plurality of control times (a pulse cycle, a pulse ON time, a first burst cycle, a first output period, a second burst cycle, and a second output period) that are control parameters. Hereinafter, the first output period, the first pause period, the second output period, and the second pause period will also be respectively referred to as a first burst ON time, a first interval time, a second burst ON time, and a second interval time, and are fundamentally the same as each other in meaning.

The power controller 15 forms a part of a control circuit controlling an operation of the image forming apparatus 100. The control circuit has a central processing unit (CPU) and a memory. The CPU reads and executes a program stored in the memory, and collectively controls the overall operation of the image forming apparatus. The memory includes a nonvolatile storage medium such as a read only memory (ROM) and a volatile storage medium such as a random access memory (RAM), and serves as a storage storing the program and data and also serves as a work area when the CPU executes the program. The memory is an example of a non-transitory storage medium storing the program for controlling the image forming apparatus. A function of the power controller 15 described below may be installed in software as the functional unit of the program executed by the CPU, and may be installed on a circuit of the controller as standalone hardware such as an ASIC. Hereinafter, each member forming the fixing unit 100F will be described in detail.

(1) Pressing Roller and Pressing Configuration

As illustrated in FIGS. 2 and 3, the pressing roller 8 facing the fixing sleeve 1 is a roller member including a core metal 8*a*, an elastic layer 8*b* around the core metal 8*a* that is formed concentrically and integrally with the core metal 8*a*, and a release layer 8*c* serving as a surface layer. The elastic layer 8*b* is made of an elastic material having heat resistance, such as silicon rubber, fluorine rubber, or fluorine resin, and is molded to coat the core metal 8*a*. Both ends of the core metal 8*a* in the longitudinal direction are rotatably held at a metal plate (not illustrated) forming a frame member of the fixing unit via a conductive bearing.

The guide member 6 is disposed inside the fixing sleeve 1 in a state of being held at a pressing stay 5, and faces the pressing roller 8 with the fixing sleeve 1 interposed therebetween. The guide member 6 is made of heat resistant resin such as polyphenylene sulfide (PPS), and forms a surface (lower surface) facing the pressing roller 8 in a circular arc (i.e., cylindrical) shape.

Pressing springs 17*a* and 17*b* are provided, in a contracted state, between both ends of the pressing stay 5 in the longitudinal direction and spring receiving members 18*a* and 18*b* (FIG. 3) provided on the frame member of the fixing unit, and apply pressing force to the pressing stay 5. In the fixing unit 100F of the present embodiment, pressing force of a total (i.e., an integrated value of applied pressure over an entire area of the fixing nip N) of about 100 N to 250 N (about 10 kgf to about 25 kgf) is applied to the pressing stay 5. The pressing force presses the lower surface of the guide member 6 against the upper surface of the pressing roller 8 with the fixing sleeve 1 interposed therebetween, and thus the fixing nip N with a predetermined width is formed. In other words, the guide member 6, along with the pressing roller 8, functions as a nip portion forming member forming the nip portion that nips and conveys a recording material bearing a toner image between the pressing roller 8 and the fixing sleeve 1.

The pressing roller 8 is rotationally driven in a predetermined direction (a counterclockwise direction in FIG. 2) by a driving unit M such as a motor, and thus torque is applied to the fixing sleeve 1 due to friction force with the outer surface of the fixing sleeve 1. Flange members 12*a* and 12*b* (FIG. 3) are fitted to outer circumferences of both ends of the guide member 6 in the longitudinal direction, and are rotatably attached thereto while right and left positions of the flange members are fixed by restriction members 13*a* and 13*b*. The flange members 12*a* and 12*b* receive the ends of the fixing sleeve 1 during rotation of the fixing sleeve 1, and restrict bias movement (or, displacement) of the fixing sleeve 1 in the longitudinal direction.

As material of the flange members 12*a* and 12*b*, phenol resin, polyimide resin, polyamide resin, polyamide imide resin, PEEK (polyether ether ketone) resin, PES (polyethersulfone) resin, PPS (polyphenylene sulfide) resin, fluororesin (PFA: perfluoroalkoxy alkanes, PTFE: polytetrafluoroethylene, FEP: fluorinated ethylene propylene, and the like), or liquid crystal polymer (LCP), or mixed resin thereof, having favorable heat resistance is preferably used.

(2) Fixing Sleeve

The fixing sleeve 1 is a tubular rotary member having a complex structure including a heating layer 1*a* (conductive layer) having a diameter of 10 to 50 mm and made of a conductive material serving as a base, an elastic layer 1*b* stacked on an outer surface thereof, and a release layer 1*c* stacked on an outer surface thereof (refer to FIG. 2). In a case where a high frequency voltage is applied to the energizing coil 3, and thus alternating magnetic flux of which a polarity is cyclically inverted is applied to the fixing sleeve 1, a circumference current (a current flowing through the heating layer 1*a* of the fixing sleeve 1 in the circumferential direction) is generated in the heating layer 1*a*, and thus the heating layer 1*a* generates heat. The heat is transmitted to the elastic layer 1*b* and the release layer 1*c* such that the whole of the fixing sleeve 1 is heated, and thus the heat is delivered to a toner image on a recording material passing through the fixing nip N.

The magnetic core 2 is inserted into the fixing sleeve 1 in the longitudinal direction (the rotational axial direction X in FIG. 4), and the energizing coil 3 is wound around the magnetic core 2. Temperature detection elements 9, 10, and 11 disposed inside the fixing sleeve 1 detect the temperature of the fixing sleeve 1. The temperature detection elements 9, 10, and 11 are all temperature detection units in the present embodiment. The temperature detection element 9 disposed at a predetermined position (a central position of the fixing sleeve 1 or the vicinity thereof) in the longitudinal direction is a first detection unit of the present embodiment, and the temperature detection elements 10 and 11 disposed outside thereof are second detection units of the present embodiment.

(3) Energizing Coil and High Frequency Converter

FIG. 4 is a perspective view illustrating the energizing coil 3 and the magnetic core 2 which serve as a magnetic field generation unit inductively heating the fixing sleeve 1, with a control block diagram of a configuration for supplying power to the fixing sleeve 1 along with the high frequency converter 16. The magnetic core 2 is disposed through a hollow portion of the fixing sleeve 1 by being fastened to a fastening portion (not illustrated), and functions as a member that concentrate magnetic force caused by an AC magnetic field generated by the energizing coil 3 inside the fixing sleeve 1 such that paths of the magnetic lines (magnetic path) pass through inside the fixing sleeve 1. Particularly, since the magnetic core 2 of the present embodiment is formed into a rod shape, and thus the magnetic path substantially does not pass through the magnetic core 2 outside the energizing coil 3, an open magnetic path is formed.

The energizing coil 3 is formed by winding a typical single wire on the magnetic core 2 in a spiral shape, and is disposed inside the hollow portion of the fixing sleeve 1. Since the energizing coil 3 is wound in a direction intersecting the rotational axis inside the fixing sleeve 1, in a case where a high frequency voltage is applied to the energizing coil 3 via the high frequency converter 16 and power supply contacts 3*a* and 3*b*, magnetic flux can be generated in a direction parallel to a rotation shaft of the fixing sleeve 1. Here, the energizing coil 3 is described as a single wire, but is not limited thereto, and may be formed of a plurality of wires integrated into one.

As illustrated in FIGS. 2 to 4, the temperature detection elements of the fixing unit 100F are provided to be inscribed to the fixing sleeve 1 on a side (an upstream side of the fixing nip N) on which the recording material P is conveyed to the fixing unit 100F. Detection of the temperature of the fixing unit 100F is performed by the first temperature detection element 9 disposed at the central position of the fixing sleeve 1 in the longitudinal direction, and the second temperature detection elements 10 and 11 disposed at end positions. The second temperature detection elements 10 and 11 provided to detect the temperature of an area (non-sheet passing area) through which the recording material P with a small size does not pass in the rotational axial direction of the fixing sleeve 1 can detect a state in which a temperature increases in the non-sheet passing area when the small-sized recording material P is successively printed.

In the present embodiment, an appropriate high frequency voltage corresponding to a temperature signal from the first temperature detection element 9 provided to detect the temperature of an area (sheet passing area) through which the recording material P passes in the rotational axial direction of the fixing sleeve 1 is applied to the power supply contacts 3*a* and 3*b* via the power controller 15 and the high frequency converter 16. Consequently, the fixing sleeve 1 is inductively heated, and thus the temperature of the surface thereof is adjusted to and maintained at a predetermined target temperature (temperature control or temperature adjustment control). The power controller 15 functions as a controller controlling the high frequency converter 16 serving as a converter.

Figure 7:
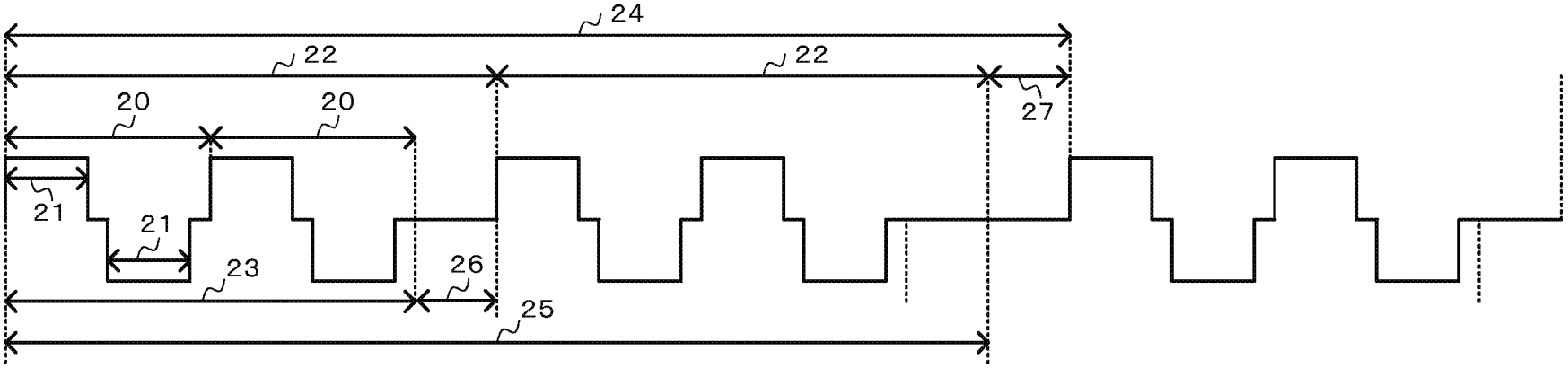
FIG. 7 is a diagram illustrating a waveform of a high frequency voltage output from a high frequency converter of Example 1.
Figure 8:
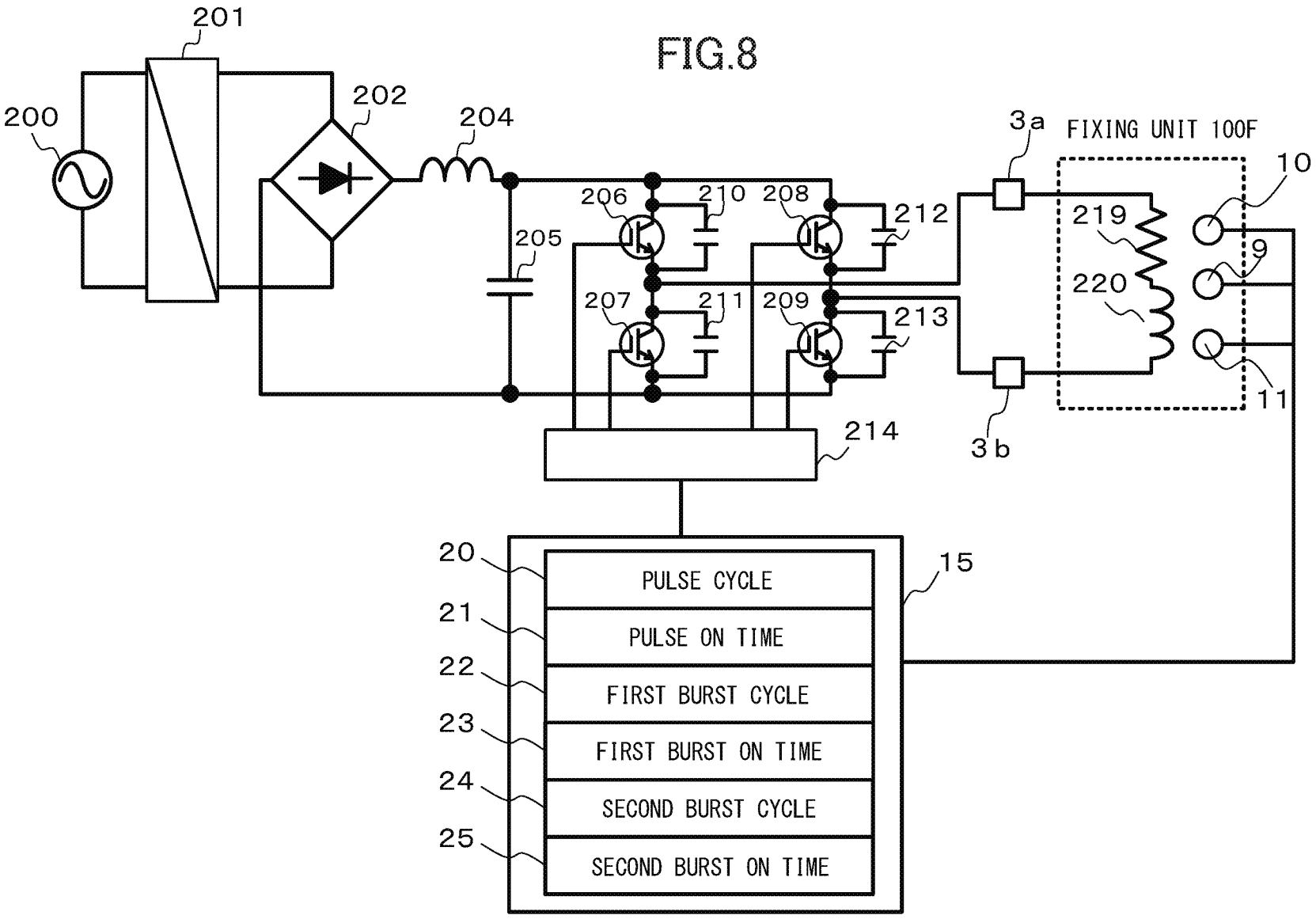
FIG. 8 is a circuit diagram of the high frequency converter of Example 1.

The power controller 15 as illustrated in FIG. 4 has, as illustrated in FIG. 8, a control portion controlling a pulse cycle of a high frequency voltage, a control portion controlling a pulse ON time, a control portion controlling a burst cycle, and a control portion controlling an output period. In the present embodiment, power control is performed by controlling control times such as a pulse cycle 20, a pulse ON time 21, a first burst cycle 22, a first output period 23, a second burst cycle 24, and a second output period 25 illustrated in FIG. 7.

The control times will be described in more detail. The pulse cycle 20 is a time from rising of a pulse to rising of the next pulse or a time from falling of a pulse to falling of the next pulse. The pulse ON time 21 is a time for which a pulse is being output. The first output period 23 is a time that is A times (where A is an integer of 1 or greater) the pulse cycle when a pulse is output. The first burst cycle 22 is a time obtained by adding any time B (where B is equal to or greater than 0) to the first output period 23, and is a time from first pulse rising in a certain first output period 23 to first pulse rising in the next first output period 23. The second output period 25 is a time that is C times (where C is an integer of 1 or greater) the first burst cycle 22. The second burst cycle 24 is a time obtained by adding any time D (where D is equal to or greater than 0) to the second output period 25 and is a time from first pulse rising in a certain second output period 25 to first pulse rising in the next second output period 25.

3. High Frequency Voltage Waveform and Method of Controlling Heat Generation Distribution First, with reference to FIGS. 5A to 5D illustrating high frequency voltage waveforms and heat generation distributions of the fixing sleeve 1, a description will be made of a method of controlling a heat generation distribution of the fixing sleeve 1 in the longitudinal direction. FIG. 5A is a diagram illustrating sinusoidal high frequency voltages applied to the power supply contacts 3*a* and 3*b* from the high frequency converter 16 and illustrating sine waves with frequencies of 90 kHz, 270 kHz, 450 kHz, 630 kHz, and 810 kHz. FIG. 5B is a diagram illustrating heat generation distributions of the fixing sleeve 1 in a case where the sine waves in FIG. 5A are applied to the power supply contacts 3*a* and 3*b* from the high frequency converter 16. Here, the heating layer 1*a* of the fixing sleeve 1 is stainless steel having a thickness of 30 μm, a diameter of 30 mm, and a length of 220 mm. The magnetic core 2 is a ferrite core having a diameter of 12 mm, a length of 270 mm, and a specific permeability of 1800. The energizing coil 3 is a wire wound densely approximately at the ends and wound sparsely at the center in terms of winding pitch. As mentioned above, the number (i.e., turning number) of turns of the coil per unit length is made different depending on a position in the longitudinal direction, and thus a substantially uniform heat generation distribution can be formed in the longitudinal direction as described below by further controlling a frequency of a high frequency voltage.

Figure 5C:
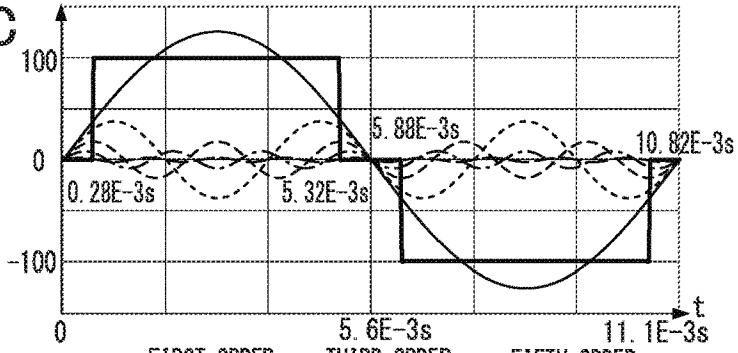
FIG. 5C is a diagram for describing a relationship between a waveform of a high frequency voltage and a heat generation distribution.
Figure 5D:
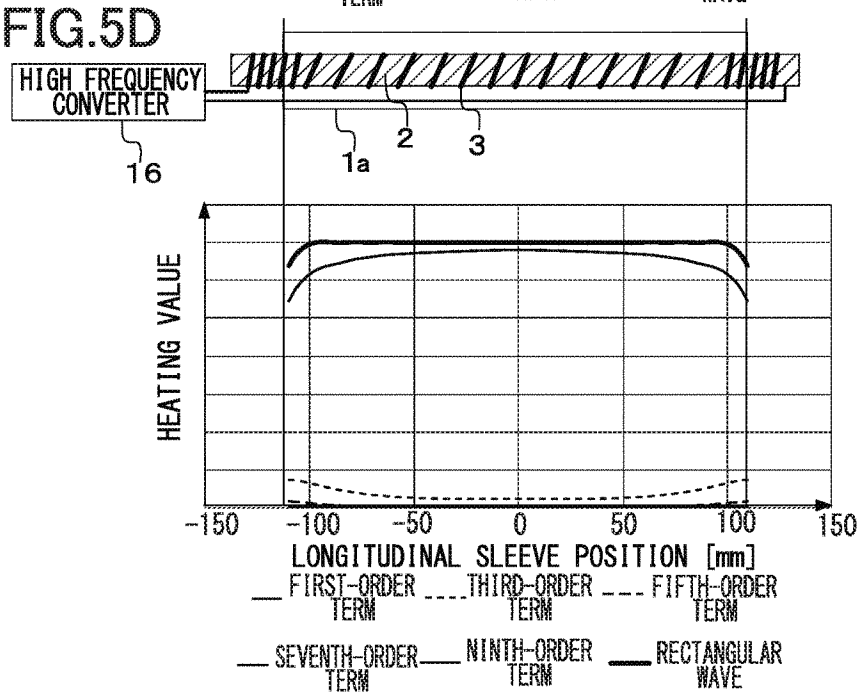
FIG. 5D is a diagram for describing a relationship between a waveform of a high frequency voltage and a heat generation distribution.
Figure 5A:
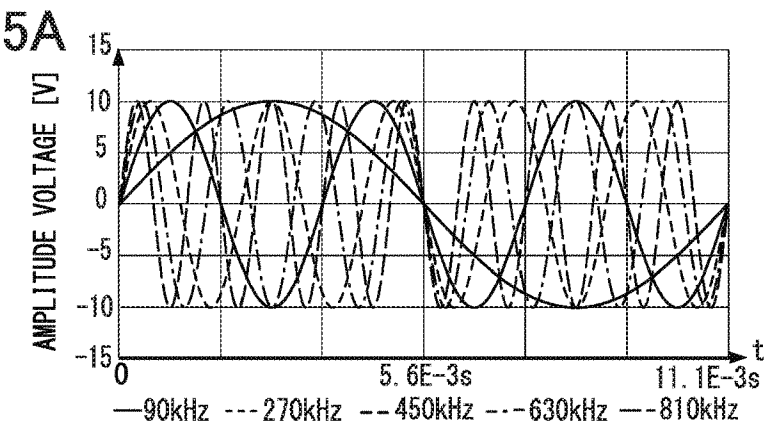
FIG. 5A is a diagram for describing a relationship between a waveform of a high frequency voltage and a heat generation distribution.
Figure 5B:
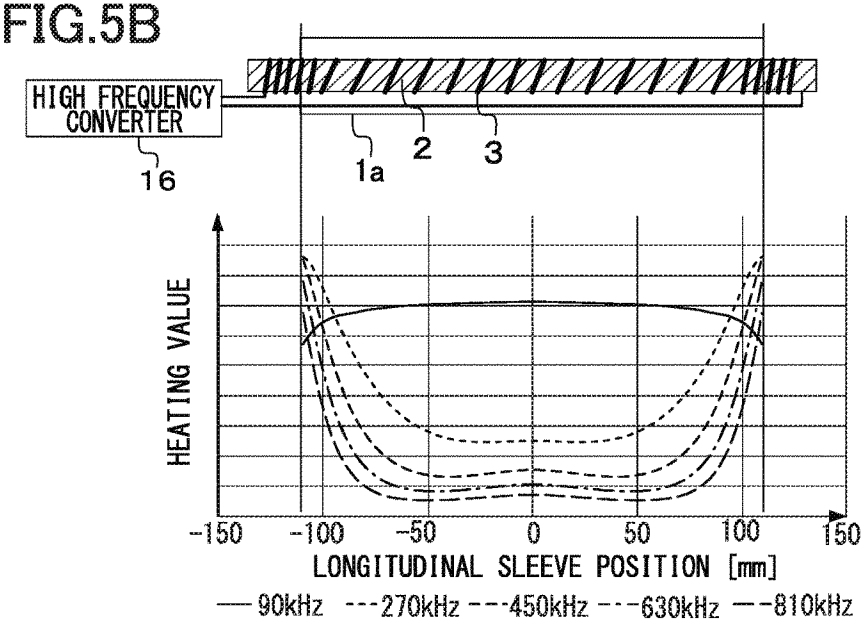
FIG. 5B is a diagram for describing a relationship between a waveform of a high frequency voltage and a heat generation distribution.

FIG. 5C is a diagram illustrating a rectangular high frequency voltage applied to the power supply contacts 3*a* and 3*b* from the high frequency converter 16, and also illustrating harmonic components obtained in a condition in which a rectangular wave is subjected to Fourier transform. FIG. 5D is a diagram illustrating a heat generation distribution of the fixing sleeve 1 in a case where the rectangular wave in FIG. 5C is applied to the power supply contacts 3*a* and 3*b* from the high frequency converter 16. Disposition of the heating layer 1*a*, the magnetic core 2, and the energizing coil 3 in FIG. 5D is the same as that in FIG. 5B.

In a case where the sine wave voltage with 90 kHz in FIG. 5A is applied to the power supply contacts 3*a* and 3*b*, as indicated by a solid line in FIG. 5B, a heat generation distribution of the fixing sleeve 1 is low at the ends and is high at the center. On the other hand, in a case where the sine waves with 270 kHz, 450 kHz, 630 kHz, and 810 kHz in FIG. 5A are applied to the power supply contacts 3*a* and 3*b*, as illustrated in FIG. 5B, a heat generation distribution of the fixing sleeve 1 is high at the ends and is low at the center, and this tendency is strengthened as the frequency increases. Next, a description will be made of a case where the rectangular wave voltage in FIG. 5C is applied to the power supply contacts 3*a* and 3*b*.

Figure 6:
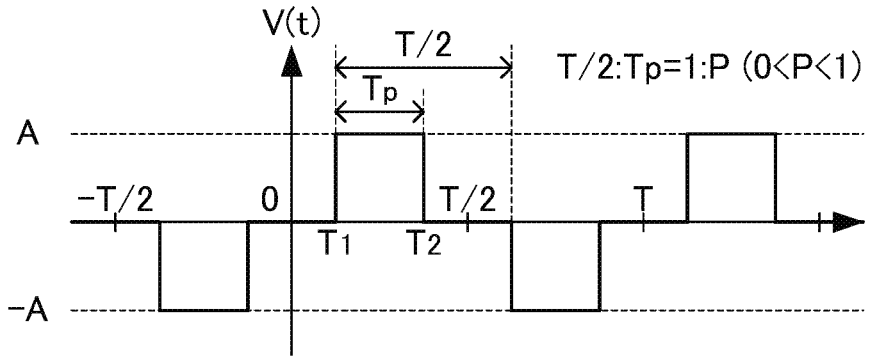
FIG. 6 is a diagram for describing a general rectangular wave.

First, a general rectangular wave will be described with reference to FIG. 6. FIG. 6 illustrates a rectangular wave having an amplitude A, a pulse cycle T, and a pulse ON time Tp, and there is a relationship of T/2:Tp=1:P (where 0<P<1). The rectangular wave may be represented by the following time function through Fourier series expansion.

$$V(t) = \sum_{m=1}^{\infty}\left[\frac{4A(-1)^{m+1}}{(2m-1)\pi}\cdot\sin\frac{(2m-1)P\pi}{2}\cdot\sin\frac{(2m-1)\cdot 2\pi}{T}t\right] \tag{1}$$

$$= \frac{4A}{\pi}\cdot\sin\frac{P\pi}{2}\cdot\sin\frac{2\pi}{T}t - \frac{4A}{3\pi}\cdot\sin\frac{3P\pi}{2}\cdot\sin\frac{3\cdot 2\pi}{T}t + \frac{4A}{5\pi}\cdot\sin\frac{5P\pi}{2}\cdot\sin\frac{5\cdot 2\pi}{T}t - \frac{4A}{7\pi}\cdot\sin\frac{7P\pi}{2}\cdot\sin\frac{7\cdot 2\pi}{T}t + \frac{4A}{9\pi}\cdot\sin\frac{9P\pi}{2}\cdot\sin\frac{9\cdot 2\pi}{T}t - \cdots$$

From Equation (1), the rectangular wave in FIG. 5C may be decomposed into a first-order term, a third-order term, a fifth-order term, a seventh-order term, a ninth-order term, . . . . Here, the first-order term corresponds to a sine wave with 90 kHz, and the third-order term to the ninth-order term respectively correspond to sine waves with 270 kHz, 450 kHz, 630 kHz, and 810 kHz, and the sine waves have waveforms different from the waveforms in FIG. 5A in terms of amplitudes. Thus, when a coefficient of each order is taken into consideration, heat generation distributions of the fixing sleeve 1 at the respective order terms (90 kHz to 810 kHz) are the same as the distributions at the first-order term to the ninth-order term in FIG. 5D.

A heat generation distribution based on the rectangular wave is an integration of the heat generation distributions at the respective orders, and thus heat can be substantially uniformly generated at a desired area of the fixing sleeve 1 in the longitudinal direction as illustrated in FIG. 5D.

In other words, in a condition in which a winding pitch of the energizing coil 3 wound around the magnetic core 2, a shape of the magnetic core 2, and other configurations are provided, a heat generation distribution when a sine wave with the same frequency as that of a rectangular wave and harmonics thereof are applied can be obtained in advance as illustrated in FIG. 5B. A heat generation distribution of the fixing sleeve 1 in a condition in which a rectangular wave is applied is the same as a result obtained by weighting heat generation distributions corresponding to the sine waves with magnitudes (the coefficients of the respective terms in Equation (1)) of respective frequency components forming the rectangular wave and integrating the weighted heat generation distributions. Thus, it is possible to obtain a configuration in which a heating value is substantially uniform over a desired area in a condition in which a rectangular wave with a predetermined cycle is applied, by adjusting a configuration such as a winding pitch of the energizing coil 3 wound around the magnetic core 2. FIG. 5D shows a result of adjusting a pulse cycle and a pulse ON time of a rectangular wave, a winding pitch of the energizing coil 3, and the like such that heat is substantially uniformly generated in a desired area of the fixing sleeve 1 in the longitudinal direction.

The desired area in which a heating value is substantially uniform is preferably an area in which the fixing sleeve 1 is brought into contact with a recording material, for example, when a recording material with a predetermined size (for example, A4 size) mainly used in the image forming apparatus 100 is supposed. As is clear from the above description, in a case where a configuration such as a winding pitch of the energizing coil 3 is changed as appropriate, there is no limitation to a distribution in which a heating value is substantially uniform in a predetermined area in the longitudinal direction, and there may be a configuration in which any heat generation distribution can be obtained in a condition in which a rectangular wave with a predetermined cycle is applied.

4. Description of High Frequency Converter

With reference to FIG. 8, a description will be made of a detailed configuration of the high frequency converter 16 that is a converter device of the present embodiment. The high frequency converter 16 is driven by an AC voltage supplied from a commercial power source 200 to generate a high frequency voltage, and applies the high frequency voltage to the power supply contacts 3*a* and 3*b* of the fixing unit 100F. In FIG. 8, the fixing unit 100F is represented by an equivalent resistance 219 and an equivalent inductance 220 connected between the power supply contacts 3*a* and 3*b*.

The high frequency converter 16 includes a filter 201, a diode bridge 202, a coil 204, a capacitor 205, switching elements 206, 207, 208, and 209, capacitors 210, 211, 212, and 213, and a drive circuit 214.

An AC voltage input from the commercial power source 200 is rectified by the diode bridge 202 that is an example of a rectification circuit, and charges the capacitor 205 via the coil 204 restricting a rapid current change. A capacitance of the capacitor 205 is set to a capacitance in a level in which noise generated from the image forming apparatus 100 is allowable when a switching current flows. This is because a power factor tends to deteriorate in a case where the capacitor having a large capacitance is connected. Thus, in a case where power is consumed by a circuit in the rear stage of the capacitor 205, a voltage across both ends of the capacitor 205 is a pulsated voltage.

The switching elements 206 to 209 and the capacitors 210 to 213 form an inverter circuit that can generate a high frequency pulse from a DC voltage. The drive circuit 214 controls switching operations of the switching elements 206 to 209 on the basis of control signals from the power controller 15.

Next, with reference to FIG. 9, operations of the switching elements 206 to 209 will be described. Vgs1 is a gate-source voltage of the switching element 206, and Vgs2 is a gate-source voltage of the switching element 207. Vgs3 is a gate-source voltage of the switching element 208, and Vgs4 is a gate-source voltage of the switching element 209. Vout indicates an output (a potential difference between the power supply contacts 3*a* and 3*b*) from the high frequency converter 16.

Figure 9:
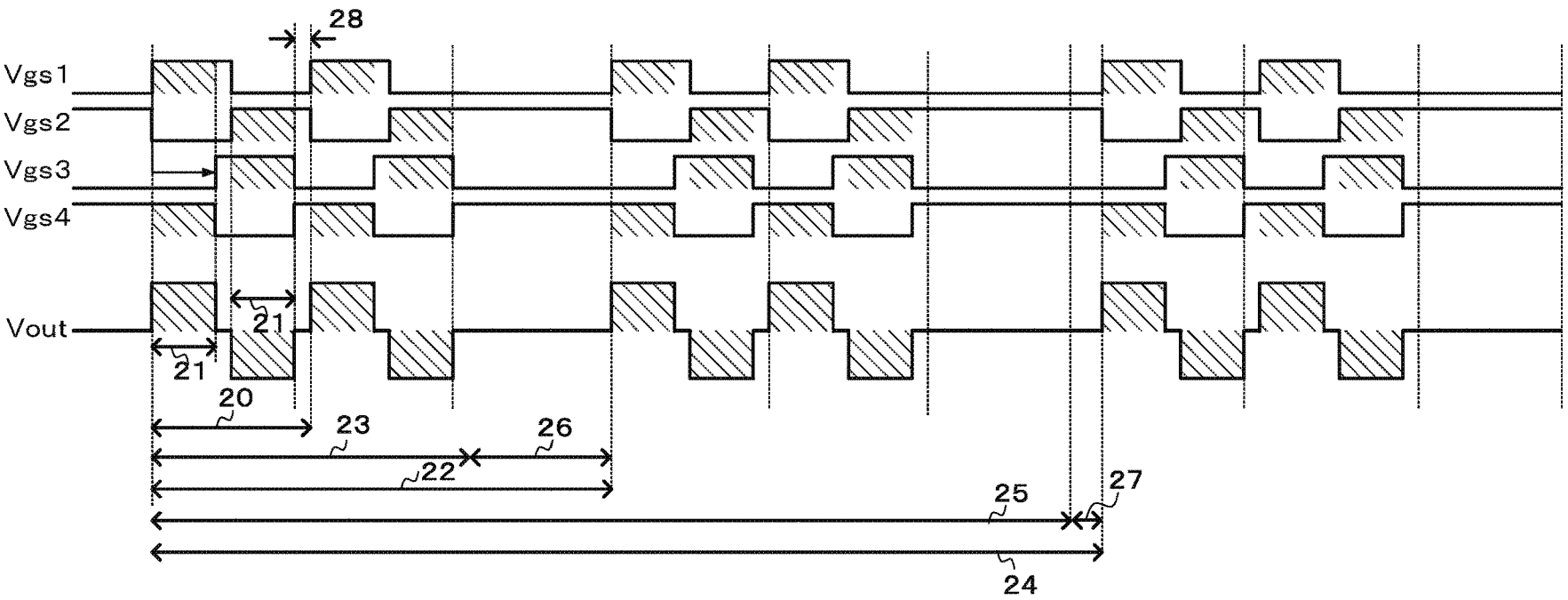
FIG. 9 is a diagram for describing generation of a pulse from an inverter circuit of the high frequency converter of Example 1.

Hatched parts in FIG. 9 are periods in which a voltage is applied to the power supply contacts 3*a* and 3*b* by turning on the switching element 206 and the switching element 209 or turning on the switching element 207 and the switching element 208, and each correspond to the pulse ON time 21.

The gate-source voltages Vgs1 and Vgs2 of the switching elements 206 and 207 have waveforms different from that of the gate-source voltages Vgs3 and Vgs4 of the switching elements 208 and 209 in terms of phase. The cycles of the gate-source voltages Vgs1, Vgs2, Vgs3, and Vgs4 of the switching elements 206, 207, 208, and 209 are the same as each other, and each cycle corresponds to the pulse cycle 20. In other words, the pulse cycle 20 is a length of a period from the time at which the gate-source voltage Vgs1 of the switching element 206 rises to the positive polarity to the time at which the gate-source voltage Vgs1 rises to the positive polarity next.

A period in which pulses of the gate-source voltages Vgs1 to Vgs4 are successively output (a period in which a plurality of pulse waves continues in Vout) corresponds to the first output period 23. In the present embodiment, the first output period 23 is an integer multiple of the pulse cycle 20. A plurality of pulses that are successively output for the first output period 23 will be hereinafter referred to collectively as a "pulse burst".

A period including the period (first output period 23) in which the pulses of the gate-source voltages Vgs1 to Vgs4 are successively output and a period (first pause period 26), subsequent to the period, in which output of the pulses is paused corresponds to the first burst cycle 22. A waveform repeated in the first burst cycle 22 is a first waveform of the present embodiment.

A period in which a plurality of pulse bursts are repeated in the first burst cycle 22 corresponds to the second output period 25. In the present embodiment, the second output period 25 is an integer multiple of the first burst cycle 22. An output waveform in the second output period 25 may be said to be a "pulse burst block" including a plurality of pulse bursts.

A period including the period (second output period 25) in which a plurality of pulse bursts are repeated in the first burst cycle 22 and a period (second pause period 27), subsequent to the period, in which output of the pulses is paused corresponds to the second burst cycle 24. A waveform repeated in the second burst cycle 24 is a second waveform of the present embodiment.

The power controller 15 may change simultaneously change one or more of the pulse ON time 21, the pulse cycle 20, the first output period 23, the first burst cycle 22, the second output period 25, the second burst cycle 24. Unless otherwise mentioned, it is assumed that a length of the first pause period 26 is changed when the first burst cycle 22 is changed. Similarly, unless otherwise mentioned, it is assumed that a length of the second pause period 27 is changed when the second burst cycle 24 is changed.

When Vout is paused in a period 28 in FIG. 9 (an output voltage is 0), logical levels of the gate-source voltages Vgs1 and Vgs3 are "L", and logical levels of the gate-source voltages Vgs2 and Vgs4 are "H". However, as long as relationships are maintained in which logical levels of the gate-source voltages Vgs1 and Vgs3 match each other, logical levels of the gate-source voltages Vgs2 and Vgs4 match each other, logical levels of the gate-source voltages Vgs1 and Vgs2 are inverse to each other, and logical levels of the gate-source voltages Vgs3 and Vgs4 are inverse to each other, the logical levels "L" and "H" may be inverse to each other.

5. Temperature Control for Fixing Sleeve 1

Next, a description will be made of temperature control (temperature adjustment control) for the fixing sleeve 1 will be described with reference to FIGS. 7 and 10A to 10D. FIG. 7 illustrates a waveform of a high frequency voltage output from the high frequency converter 16 of the present embodiment. Control parameters being set when the power controller 15 controls the output waveform are six parameters such as the pulse cycle 20, the pulse ON time 21, the first burst cycle 22, the first output period 23, the second burst cycle 24, and the second output period 25.

The pulse cycle 20 is a time from rising of a pulse to rising of the next pulse or a time from falling of a pulse to falling of the next pulse. The pulse cycle 20 is a time twice the time from rising or falling of a pulse to the next falling or the next rising of the pulse.

The pulse ON time 21 is a time for which a single pulse is turned ON toward a positive side or a negative side. The first output period 23 is a time for which the pulse cycle 20 is repeated A times, where A is an integer of 1 or greater. The first burst cycle 22 is a time obtained by adding any time (i.e., first pause period 26) for which pulse output is paused to the first output period 23. The second output period 25 is a time obtained by repeating the first burst cycle 22 C times, where C is an integer of 1 or greater. The second burst cycle 24 is a time obtained by adding any time (i.e., second pause period 27) for which pulse output is paused to the second output period 25. In a case where A is 1, the pulse cycle 20 is a time twice the time from rising or falling of a pulse to the next falling or the next rising of the pulse. FIG. 7 illustrates an example in which A is 2, and C is 2.

FIGS. 10A to 10D are diagrams for describing a temperature control method of the present embodiment, and illustrate a case where temperature control is performed by using the pulse ON time 21 among the control parameters in FIG. 7. Here, a description will be made of a case where A is 2, and C is 8.

Figures 10A, 10B, 10C, 10D:
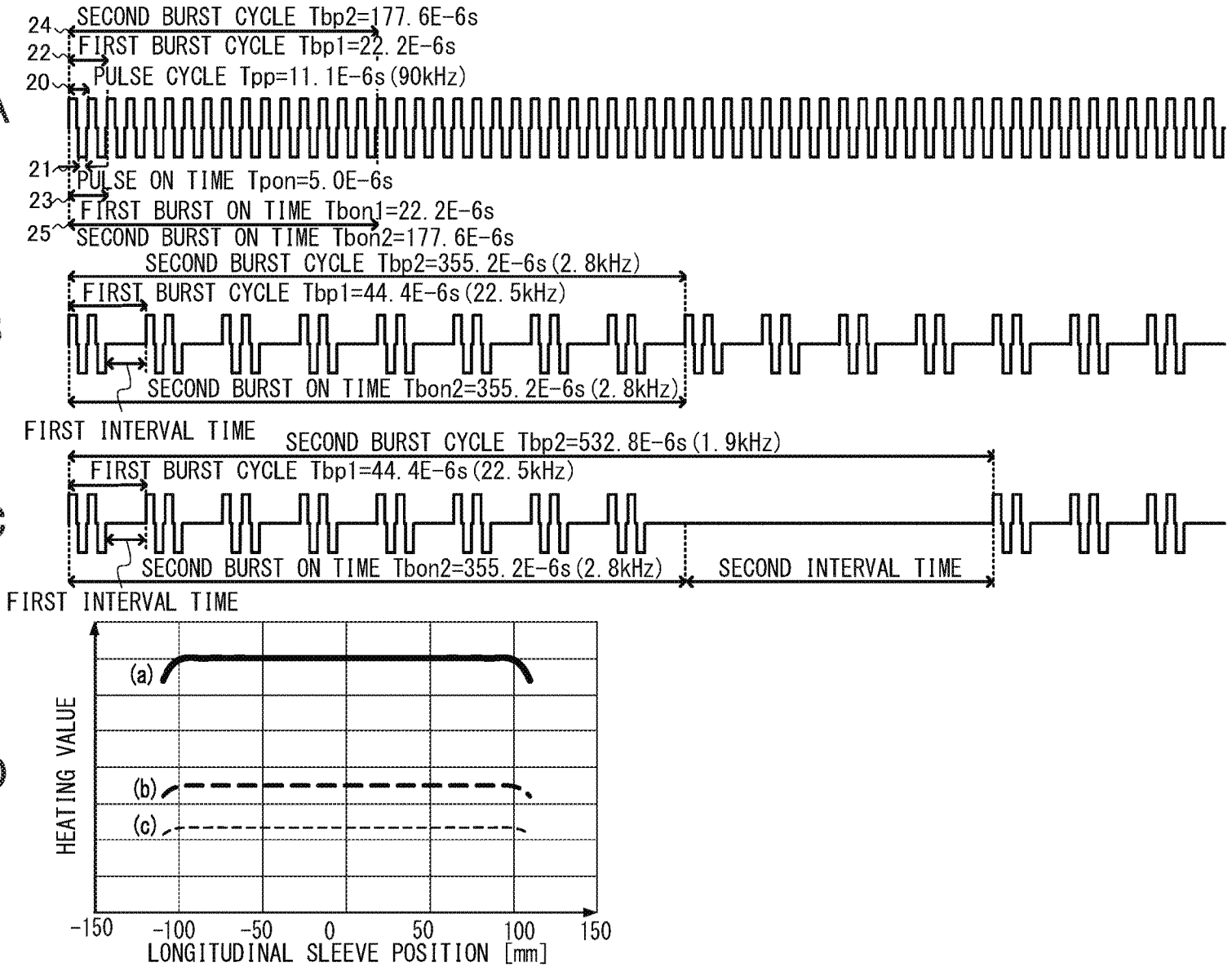
FIG. 10A is a diagram for describing temperature control of Example 1.
FIG. 10B is a diagram for describing the temperature control of Example 1.
FIG. 10C is a diagram for describing the temperature control of Example 1.
FIG. 10D is a diagram for describing the temperature control of Example 1.

FIG. 10A illustrates an output waveform from the high frequency converter 16 when the fixing sleeve 1 generates heat at the maximum heating value according to substantially uniform heat generation as indicated by a solid line (a) in FIG. 10D. In a case where the pulse cycle 20 is indicated by Tpp, the pulse ON time is indicated by Tpon, the first burst cycle 22 is indicated by Tbp1, the first output period 23 is indicated by Tbon1, the second burst cycle 24 is indicated by Tbp2, and the second output period 25 is indicated by Tbon2, the following relationship is established.

$$\text{Tbon1}=A\times Tpp=2\times Tpp \tag{2}$$

$$\text{Tbon2}=C\times\text{Tbon1}=8\times\text{Tbon1} \tag{3}$$

In FIG. 10A, the respective control parameters are set to the following values. Hereinafter, unless otherwise mentioned, the values of the control parameters are represented by E notation.

Tpp=11.1E-6 (seconds)

Tpon=5.0E-6 (seconds)

Tbon1=2× Tpp=22.2E-6 (seconds)

Tbp1=Tbon1=22.2E-6 (seconds)

Tbp2=Tbon2=8×Tbon1=177.6E-6 (seconds)

In a case where the first pause period 26 is indicated by Tint1, and the second pause period 27 is indicated by Tint2, Tint1 and Tint2 are represented as follows.

Tint1=Tbp1−Tbon1=0 (seconds)

Tint2=Tbp2−Tbon2=0 (seconds)

FIG. 10B illustrates an output waveform from the high frequency converter 16 when a heating value is set to ½ of the maximum heating value as indicated by a dashed line (b) in the heating value distribution diagram of FIG. 10D. In this case, the respective control parameters are set to the following values.

Tpp=11.1E-6 (seconds) (invariable)

Tpon=5.0E-6 (seconds) (invariable)

Tbon1=2×Tpp=22.2E-6 (seconds) (invariable)

Tbp1=44.4E-6 (seconds) (variable)

Tbp2=Tbon2=8×Tbon1=355.2E-6 (seconds) (variable)

Tint1=Tbp1−Tbon1=22.2E-6 (seconds)

Tint2=Tbp2−Tbon2=0 (seconds)

As mentioned above, the length (Tbp1) of the first burst cycle 22 is increased, i.e., the first pause period (Tint1) is increased, and thus a pulse occurrence frequency is lower than in FIG. 10A (reduced to ½ in this example). Thus, a heating value of the fixing sleeve 1 is restricted more than in the case of FIG. 10A.

The length (Tbp1) of the first burst cycle 22, which is noted (variable) as above, is adjusted within a range from 22.2E-6 seconds to 44.4E-6 seconds, and thus any heating value can be obtained between the solid line (a) and the dashed line (b) in FIG. 10D. A heating value of the fixing sleeve 1 may also be changed by changing the length (Tbon1) of the first output period 23 and thus changing the number of pulses in a single pulse burst.

As described above, the output waveform illustrated in FIG. 10B is an example of a first cyclic waveform in which a partial waveform (i.e., first waveform) is cyclically repeated as the repetition unit, the partial waveform being a waveform in which successive output of pulses in a constant cycle is repeated for the first output period, and then output of pulses is paused for the first pause period. An operation state of controlling heat generation in the fixing sleeve 1 by controlling an output waveform from the high frequency converter 16 with the first waveform as the repetition unit corresponds to a first mode of the present embodiment.

FIG. 10C illustrates an output waveform from the high frequency converter 16 when a heating value is set to ⅔ of the heating value shown in FIG. 10B as indicated by a thin dotted line (c) in the heating value distribution diagram of FIG. 10D. In this case, the respective control parameters are set to the following values.

Tpp=11.1E-6 (seconds) (invariable)

Tpon=5.0E-6 (seconds) (invariable)

Tpon2=6.66E-6 (seconds) (invariable)

Tbon1=2×Tpp=22.2E-6 (seconds) (invariable)

Tbp1=44.4E-6 (seconds) (invariable)

Tbon2=8×Tbon1=355.2E-6 (seconds) (invariable)

Tbp2=532.8E-6 (variable)

Tint1=Tbp1−Tbon1=22.2E-6 (seconds)

Tint2=Tbp2−Tbon2=177.6E-6 (seconds)

As mentioned above, the length (Tbp1) of the second burst cycle 22 is increased, i.e., the second pause period (Tint2) is increased, and thus a pulse occurrence frequency is lower than in FIG. 10B (reduced to ⅔ in this example). Thus, a heating value of the fixing sleeve 1 is restricted more than in the case of FIG. 10B.

The length (Tbp2) of the second burst cycle 24, which is noted (variable) as above, is set to any value greater than 355.2E-6 seconds, and thus any heating value can be obtained between the solid line (a) and the dashed line (b) in FIG. 10D. A heating value of the fixing sleeve 1 may also be changed by changing the length (Tbon2) of the second output period 25 and thus changing the number of pulse bursts in a single pulse burst block waveform.

As described above, the output waveform illustrated in FIG. 10C is an example of a second cyclic waveform in which a partial waveform (i.e., second waveform) is cyclically repeated as the repetition unit, the partial waveform being a waveform in which a waveform repeated in the first burst cycle is continued for the second output period, and then output of pulses is paused for the second pause period. An operation state of controlling heat generation in the fixing sleeve 1 by controlling an output waveform from the high frequency converter 16 with the second waveform as the repetition unit corresponds to a second mode of the present embodiment.

Here, a description will be made of a case where a specific frequency component can be prevented from being included in a drive voltage for the coil in the induction heating type fixing unit by performing the output waveform control.

Herein, a description will be made of a case of avoiding a frequency component of 3 kHz or higher and 20 kHz or lower. When a component of about 17 kHz is included in a drive voltage for the energizing coil 3, unpleasant noise known as a mosquito sound may be generated from a fixing unit. When a component of 3 kHz to 20 kHz is included in a drive voltage for the energizing coil 3, it is known that vibration in the fixing sleeve 1 causing image quality deterioration occurs.

In the first mode, a heating value of the fixing sleeve 1 is controlled by changing the length (Tbp1) of the first burst cycle 22 between the waveform in FIG. 10A and the waveform in FIG. 10B. In this case, the maximum value (44.4E-6 seconds) of the first burst cycle 22 is set to be shorter than a cycle corresponding to 20 kHz. In other words, the first output period and the first pause period are set such that the first burst cycle defined by a sum of the first output period and the first pause period is shorter than a range of cycles corresponding to a predetermined frequency band. Thus, a frequency of a waveform repeated in the first burst cycle 22 is not included in a frequency band higher than 3 kHz.

When a heating value cannot be restricted to a desired level although the first burst cycle 22 is increased to the maximum value, as illustrated in FIG. 10C, the second pause period 27 is provided, and transition to the second mode occurs.

In the second mode, as illustrated in FIG. 10C, a heating value of the fixing sleeve 1 is controlled by changing the length (Tbp2) of the second burst cycle 24. In this case, the second output period (355.2E-6 seconds) that is the minimum value of the second burst cycle 24 is set to be longer than a cycle corresponding to 3 kHz. In other words, the second output period and the second pause period are set such that the second burst cycle defined by a sum of the second output period and the second pause period is longer than a range of cycles corresponding to a predetermined frequency band. Thus, a frequency of a waveform repeated in the second burst cycle 24 is not included in a frequency band lower than 20 kHz.

As mentioned above, in the configuration of driving the energizing coil 3 by using burst pulses, it is possible to prevent a specific frequency component from being included in an output waveform by changing an output waveform control mode for the high frequency converter 16 according to a necessary heating value. Therefore, it is possible to control a heating value and also to prevent a problem due to a specific frequency component being included in a drive voltage with a simple configuration.

6. Description of Temperature Control Procedure

Figure 11A:
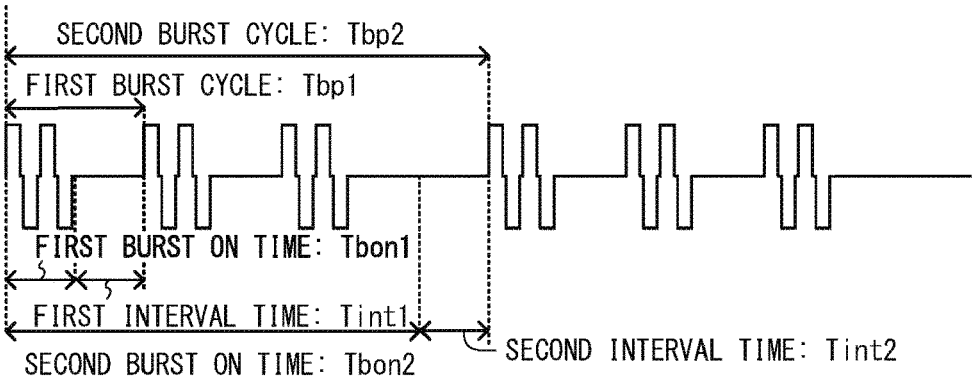
FIG. 11A is a diagram for describing a procedure of temperature control of Example 1.
Figure 11B:
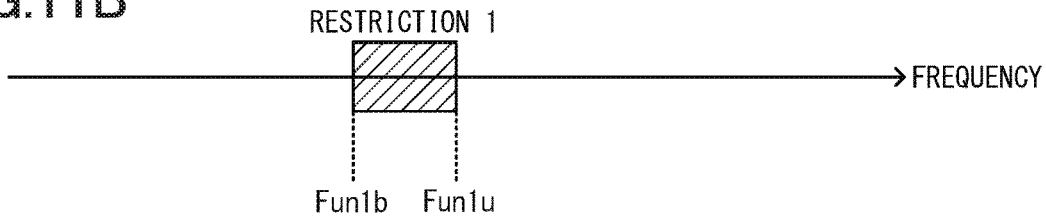
FIG. 11B is a diagram for describing the procedure of temperature control of Example 1.
Figure 11C:
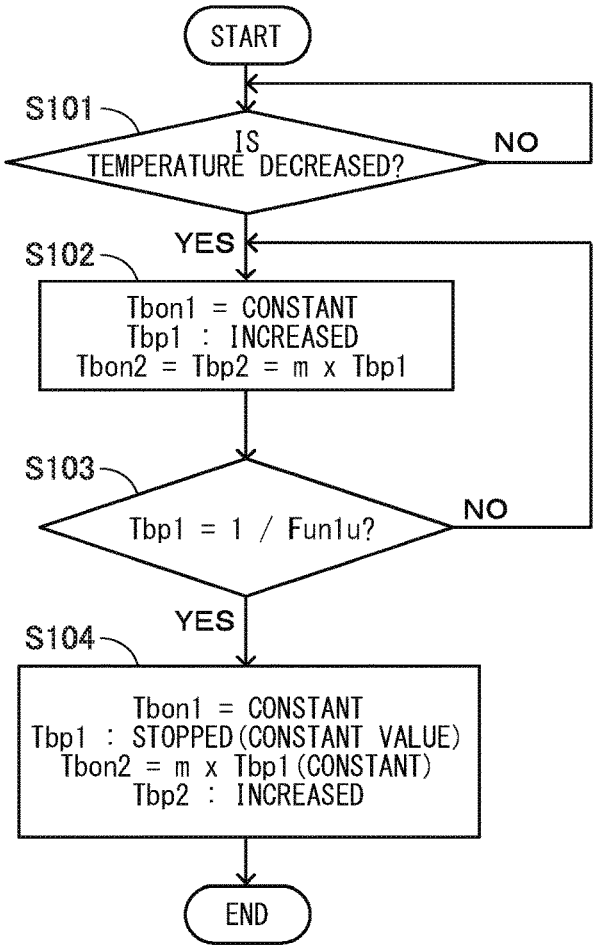
FIG. 11C is a diagram for describing the procedure of temperature control of Example 1.

With reference to FIGS. 11A to 11C, a control method for the high frequency converter 16 for realizing the operation will be described.

In FIG. 11A, control parameters used to control the temperature of the fixing sleeve 1 are indicated by variables. In other words, the first output period 23 is indicated by Tbon1, the first burst cycle 22 is indicated by Tbp1, the second output period 25 is indicated by Tbon2, and the second burst cycle 24 is indicated by Tbp2. The pulse cycle 20 and the pulse ON time 21 are set to any steady-state values.

FIG. 11B is a conceptual diagram illustrating a frequency band to be restricted in an output waveform from the high frequency converter 16. Herein, a description will be made of a case of restricting a frequency band from a frequency Fun1b to a frequency Fun1u (where Fun1b<Fun1u).

FIG. 11C is a flowchart illustrating a procedure for controlling the temperature of the fixing sleeve 1 such that a component of the frequency band illustrated in FIG. 11B is prevented from being included in an output waveform from the high frequency converter 16. Each step of the flowchart is performed by the power controller 15.

Herein, a description will be made of a procedure in which the temperature of the fixing sleeve 1 is decreased by reducing a heating value of the fixing sleeve 1 in a state in which the fixing sleeve 1 generates heat at the maximum heating value (a state in which an output waveform is illustrated in FIG. 10A). In a case where the pulse cycle 20 and the pulse ON time 21 are set to any steady-state values, values of the respective control parameters in a state in which the fixing sleeve 1 generates heats at the maximum heating value have a following relationship. In FIG. 11A, the number of pulse bursts in a single pulse burst block is set to m=3 (the case of m=8 has been described in FIGS. 10B and 10C).

$$\text{Tbon1}=Tbp1 \tag{4}$$

$$\text{Tbon2}=Tbp2=m\times Tbp1 \text{ (where } m \text{ is an integer)} \tag{5}$$

$$\text{Tbon1}<1/Fun1u \tag{6}$$

In a case where the temperature of the fixing sleeve 1 is decreased (S101), as illustrated in FIG. 11C, Tbp1 is first increased (S102). In this case, Tbon1 is the same constant value as in the initial state, and Tbon2 and Tbp2 are increased while keeping the relationship of Equation (5) satisfied.

In a case where Tbp1 is increased to 1/Fun1u (S103), that is, the first burst cycle reaches a lower limit of a range of cycles corresponding to the frequency band to be restricted, the increase of Tbp1 is stopped, and Tbp2 starts to be increased (S104). Tbon2 also stops being increased along with stopping of the increase of Tbp1. In this case, a value of the integer m is selected in advance such that the following relationship is established.

$$\text{Tbon2}>1/Fun1b \tag{7}$$

In the above procedure, when it is determined that the fixing sleeve 1 is decreased to a desired temperature on the basis of detection results from the temperature detection elements 9 to 11, the power controller 15 stops the procedure, and maintains values of the control parameters at that time.

An output waveform from the high frequency converter 16 based on the control parameters determined in S102 has the waveform with the first burst cycle (Tbp1) as the repetition unit as illustrated in FIG. 10B. Since an upper limit of Tbp1 is set to 1/Fun1u, a frequency of the waveform repeated in the first burst cycle in the first mode is not lower than Fun1u.

On the other hand, an output waveform from the high frequency converter 16 based on the control parameters determined in S104 has, as the repetition unit, the waveform with the second burst cycle (Tbp2) including a plurality of waveforms with the first burst cycle (Tbp1) as illustrated in FIG. 10C. Since a lower limit of Tbp2 is set to a value greater than 1/Fun1b as in Equation (7), a frequency of the waveform repeated in the second burst cycle in the second mode is not higher than Fun1b. A frequency of the waveform with the first burst cycle included in a plurality in the waveform repeated in the second burst cycle is not lower than Fun1u since the increase of Tbp1 is stopped when Tbp1 is increased to 1/Fun1u.

In a case where the temperature of the fixing sleeve 1 is increased from a low temperature state, a procedure reverse to the above-described procedure is performed. Also in this case, when it is determined that the fixing sleeve 1 is increased to a desired temperature on the basis of detection results from the temperature detection elements 9 to 11, the power controller 15 stops the procedure, and maintains values of the control parameters at that time. In a case where it is detected that the temperature of the fixing sleeve 1 is higher or lower than a target temperature by using the temperature detection elements 9 to 11, the control parameters are adjusted at any time according to the procedure in FIG. 10C or the reverse procedure every time that happens. As mentioned above, since the control parameters are changed at any time on the basis of detection results from the temperature detection elements 9 to 11, and thus an output waveform from the high frequency converter 16 is controlled, the fixing sleeve 1 can be maintained at a target temperature.

As mentioned above, since the control parameters are determined according to a necessary heating value, it is possible to prevent a component of a frequency band from Fun1b to Fun1u from being included in an output waveform from the high frequency converter 16 when the temperature of the fixing sleeve 1 is controlled. Therefore, it is possible to control a heating value with a simple configuration and also to prevent a problem due to a specific frequency component being included in a drive voltage.

In the above description, an example of a control method has been described by using the full-bridge type inverter circuit as an example of a circuit. An advantage of the full-bridge type circuit is that power supply efficiency is high. However, as illustrated in FIG. 7, a circuit and a control method in which an output waveform from the high frequency converter switches between positive and negative polarities may be used, and the present technique is not limited to the full-bridge type circuit. In other words, pulses output from the high frequency converter are not limited to having the same waveform in a positive half wave and a negative half wave, and an output waveform from the high frequency converter may have different shapes in positive and negative polarities by including, for example, an active clamp type circuit.

As mentioned above, according to the present embodiment, it is possible to configure the fixing unit serving as an image heating unit in which the energizing coil is disposed inside the fixing sleeve 1, an alternating magnetic field is generated along an axial direction of the rotary member by applying a high frequency voltage to the energizing coil, and thus the rotary member generates heats. It is possible to provide the fixing unit capable of supplying a necessary heating value while a desired heat generation distribution is maintained in the longitudinal direction of the rotary member with a simple configuration. It is possible to suppress the occurrence of a problem due to a component of a frequency band by preventing the desired frequency band from being included in a drive voltage for the energizing coil.

Example 2

A description has been made of a case where the number of frequency bands to be restricted is one in Example 1, but a description will be made of a configuration in which a plurality of frequency bands can be simultaneously restricted as Example 2 (i.e., a second embodiment).

Figure 12A:
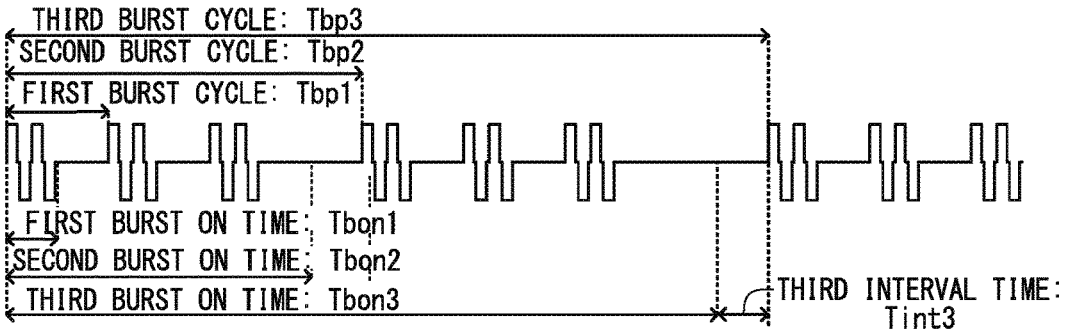
FIG. 12A is a diagram for describing a procedure of temperature control of Example 2.

FIG. 12A illustrates an output waveform from the high frequency converter 16 and control parameters used to control the temperature of the fixing sleeve 1 in the present embodiment, the control parameters being indicated by variables. In the present embodiment, as illustrated in FIG. 10C in Example 1, there is a mode of controlling an output waveform from the high frequency converter 16 by using, as the repetition unit, a waveform in which the waveform with the second burst cycle is repeated for a third output period, and then output of a pulse is paused for a third pause period. This mode described below is a third mode of the present embodiment. In FIG. 12A, the first output period is indicated by Tbon1, the first burst cycle is indicated by Tbp1, the second output period is indicated by Tbon2, and the second burst cycle is indicated by Tbp2. The third output period is indicated by Tbon3, the third burst cycle is indicated by Tbp3, and the third pause period is indicated by Tint3. The pulse cycle 20 and the pulse ON time 21 are set to any steady-state values.

Figure 12B:
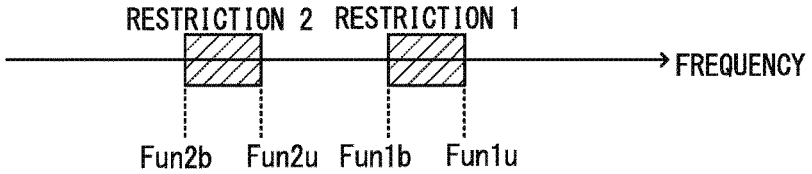
FIG. 12B is a diagram for describing the procedure of temperature control of Example 2.

FIG. 12B is a conceptual diagram illustrating frequency bands to be restricted in an output waveform from the high frequency converter 16. Herein, a description will be made of a case of restricting components of a first frequency band from a frequency Fun 1*b* to a frequency Fun1u (where Fun1b<Fun1u), and a second frequency band from a frequency Fun2b to a frequency Fun2u (where Fun2b<Fun2u).

Figure 12C:
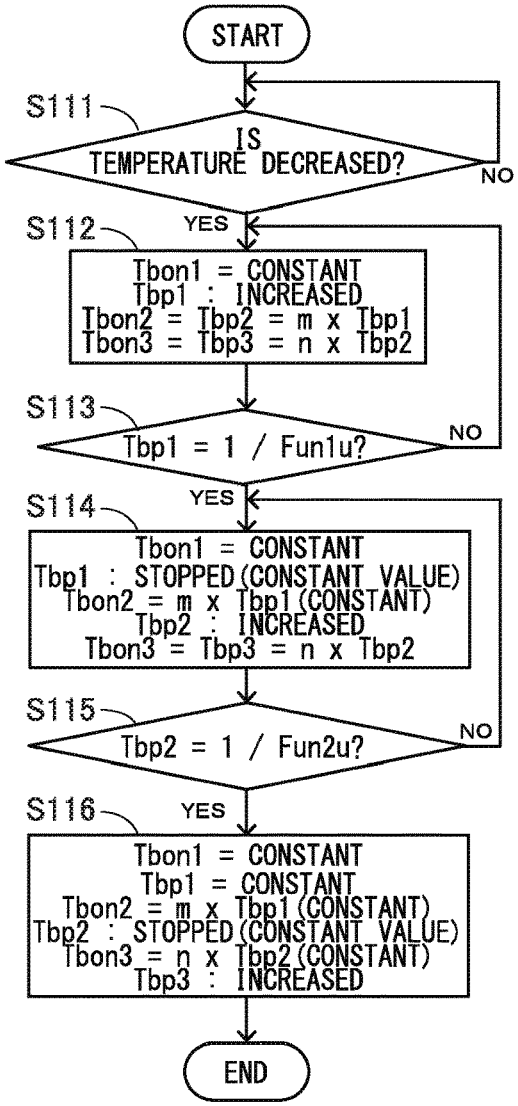
FIG. 12C is a diagram for describing the procedure of temperature control of Example 2.

FIG. 12C is a flowchart illustrating a procedure for controlling the temperature of the fixing sleeve 1 such that components of the frequency bands illustrated in FIG. 12B are prevented from being included in an output waveform from the high frequency converter 16. Each step of the flowchart is performed by the power controller 15.

Herein, a description will be made of a procedure in which the temperature of the fixing sleeve 1 is decreased by reducing a heating value of the fixing sleeve 1 in a state in which the fixing sleeve 1 generates heat at the maximum heating value (a state in which an output waveform is illustrated in FIG. 10A). In a case where the pulse cycle 20 and the pulse ON time 21 are set to any steady-state values, values of the respective control parameters in a state in which the fixing sleeve 1 generates heats at the maximum heating value have a following relationship. In FIG. 12A, m is 3, and n is 2.

$$\text{Tbon1}=Tbp1 \tag{8}$$

$$\text{Tbon2}=Tbp2=m\times Tbp1 \text{ (where } m \text{ is an integer)} \tag{9}$$

$$\text{Tbon3}=Tbp3=n\times Tbp2 \text{ (where } n \text{ is an integer)} \tag{10}$$

$$\text{Tbon1}<1/Fun1u \tag{11}$$

In a case where the temperature of the fixing sleeve 1 is decreased (S111), as illustrated in FIG. 12C, Tbp1 is first increased (S112). In this case, Tbon1 is the same constant value as in the initial state, and Tbon2, Tbp2, Tbon3, and Tbp3 are increased while being maintained to have the relationship of Equations (9) and (10).

In a case where Tbp1 is increased to 1/Fun1u (S113), that is, the first burst cycle reaches a lower limit of a range of cycles corresponding to the first frequency band to be restricted, the increase of Tbp1 is stopped, and Tbp2 starts to be increased (S114). Tbon2 also stops being increased along with stopping of the increase of Tbp1. In this case, a value of the integer m is selected in advance such that the following relationship is established.

$$\text{Tbon2}>1/Fun1b \tag{12}$$

In a case where Tbp2 is increased to 1/Fun2u (S115), that is, the second burst cycle reaches a lower limit of a range of cycles corresponding to the second frequency band to be restricted, the increase of Tbp2 is stopped, and Tbp3 starts to be increased (S116). Tbon3 also stops being increased along with stopping of the increase of Tbp2. In this case, a value of the integer n is selected in advance such that the following relationship is established.

$$\text{Tbon3}>1/Fun2b \tag{13}$$

In the above procedure, when it is determined that the fixing sleeve 1 is decreased to a desired temperature on the basis of detection results from the temperature detection elements 9 to 11, the power controller 15 stops the procedure, and maintains values of the control parameters at that time.

Here, even in a case of using an output waveform (refer to FIG. 10B) from the high frequency converter 16 based on the control parameters determined in S114, a heating value can be reduced to any level when the second burst cycle is increased by increasing the second interval. However, in a case where the length (Tbp2) of the second burst cycle exceeds 1/Fun2u, a waveform repeated in the second burst cycle includes a frequency component of the second frequency band to be restricted.

According to the present embodiment, in a case where Tpb2 is increased to 1/Fun2u, the third pause period (Tint3) is provided instead of the increase of Tbp2 being stopped, and an output waveform is in a state of being repeated in the third burst cycle (Tbp3) (the third mode in this embodiment; refer to FIG. 12A). In other words, the output waveform illustrated in FIG. 12A is an example of a third cyclic waveform in which a partial waveform (i.e., third waveform) is cyclically repeated as the repetition unit, the partial waveform being a waveform in which the waveform repeated in the second burst cycle is continued for the third output period, and then output of pulses is paused for the third pause period. From the relationship of Expression (13), the third burst cycle is longer than a range of cycles corresponding to the second frequency band. Since Tbp2 is not longer than 1/Fun2u, a plurality of waveforms with the second burst cycle included in the waveform repeated in the third burst cycle are prevented from including a frequency component of the second frequency band.

For the same reason as in Example 1, an output waveform (an output waveform in the first mode or the second mode) from the high frequency converter 16 based on the control parameters determined in S112 or S114 is prevented from including frequency components from Fun1b to Fun1u.

In a case where the temperature of the fixing sleeve 1 is increased from a low temperature state, a procedure reverse to the above-described procedure is performed. Also in this case, when it is determined that the fixing sleeve 1 is increased to a desired temperature on the basis of detection results from the temperature detection elements 9 to 11, the power controller 15 stops the procedure, and maintains values of the control parameters at that time.

According to this procedure, it is possible to prevent components of a plurality of frequency bands from being included in an output waveform from the high frequency converter 16. Therefore, for example, even in a case where a frequency band causing a mosquito sound to be generated and a frequency band causing vibration resulting in image quality deterioration do not overlap each other, it is possible to control the temperature of the fixing sleeve 1 while preventing components of the frequency bands from being included in an output waveform. Note that the present embodiment can be expanded, with appropriate modification and/or additional settings, to cope with a case where three or more frequency bands are suppressed.

As mentioned above, according to the configuration of the present embodiment, it is possible to control a heating value with a simple configuration and also to prevent a problem due to a specific frequency component being included in a drive voltage.

Example 3

Hereinafter, a configuration according to Example 3 will be described. The present embodiment is different from Example 1 in that a distribution of a heating value of the fixing sleeve 1 in the longitudinal direction is positively changed by changing a pulse cycle and a pulse ON time according to a detection result from a temperature detection element or a size of a recording material. A temperature control method, a configuration of the high frequency converter 16, and a mechanical configuration of the image forming apparatus are the same as those in Example 1, and thus description thereof will not be repeated.

Figure 13A:
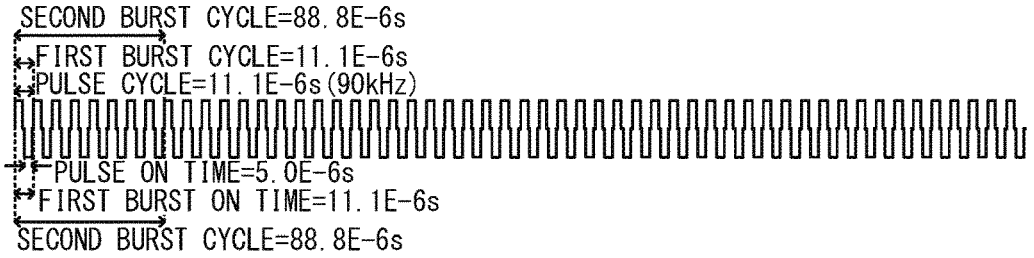
FIG. 13A is a diagram illustrating a waveform of a high frequency voltage of Example 3.

FIGS. 13A to 13F are diagrams for describing heat generation area control of the present embodiment. FIG. 13A illustrates an output waveform from the high frequency converter 16 in a case where a heat generation distribution of the fixing sleeve 1 is substantially uniform in the longitudinal direction as indicated by a solid line (a) in FIG. 13F. In a case where the pulse cycle 20 is indicated by Tpp, the pulse ON time is indicated by Tpon, the first burst cycle 22 is indicated by Tbp1, the first output period 23 is indicated by Tbon1, the second burst cycle 24 is indicated by Tbp2, and the second output period 25 is indicated by Tbon2, the following relationship is established. Herein, a case where A is 1 and C is 8 will be described.

$$\text{Tbon1}=A\times Tpp=1\times Tpp \tag{14}$$

$$\text{Tbon2}=C\times\text{Tbon1}=8\times\text{Tbon1} \tag{15}$$

In FIG. 13A, the respective control parameters are set to the following values.

Tpp=11.1E-6 (seconds)
Tpon=5.0E-6 (seconds)
Tbon1=1×Tpp=11.1E-6 (seconds)
Tbp1=Tbon1=11.1E-6 (seconds)
Tbp2=Tbon2=8×Tbon1=88.8E-6 (seconds)

Figure 13B:
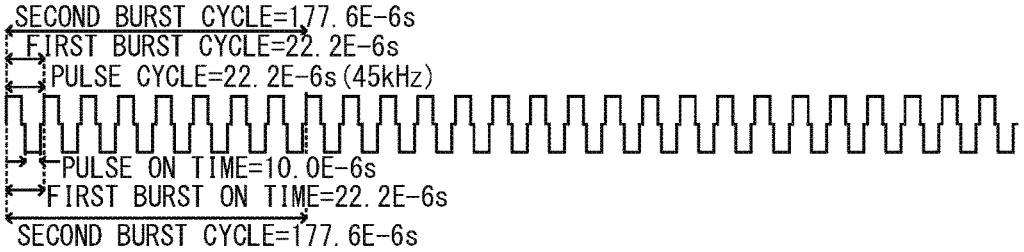
FIG. 13B is a diagram illustrating a waveform of a high frequency voltage of Example 3.
Figure 13C:
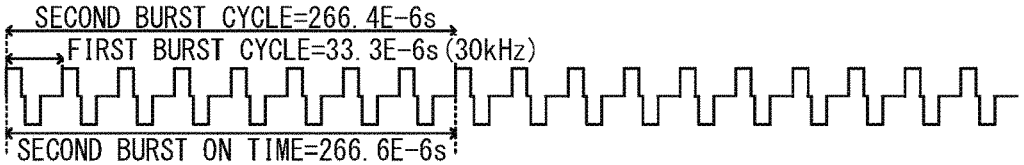
FIG. 13C is a diagram illustrating a waveform of a high frequency voltage of Example 3.
Figure 13D:
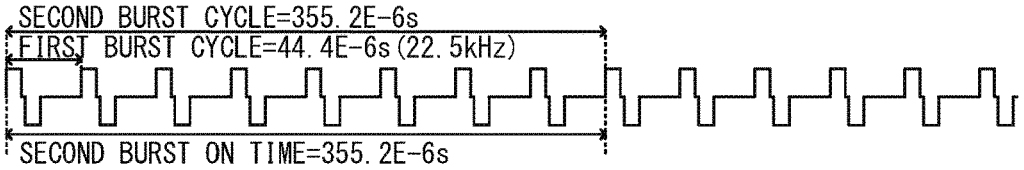
FIG. 13D is a diagram illustrating a waveform of a high frequency voltage of Example 3.
Figure 13E:
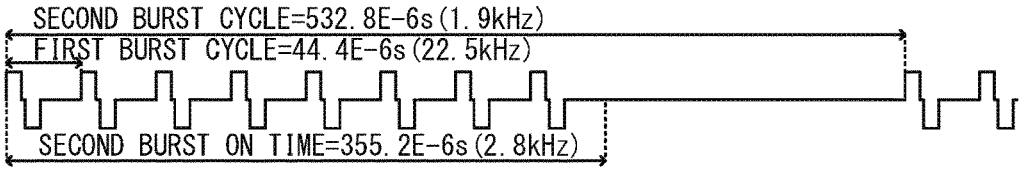
FIG. 13E is a diagram illustrating a waveform of a high frequency voltage of Example 3.
Figure 13F:
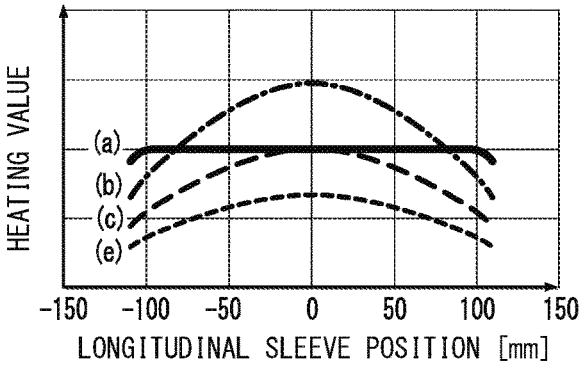
FIG. 13F is a diagram illustrating a heat generation distribution of Example 3.

FIG. 13B illustrates an output waveform from the high frequency converter 16 corresponding to a heat generation distribution indicated by a dot chain line (b) in FIG. 13F. The length Tpon of the pulse cycle is twice the length in FIG. 13A, and values of other control parameters are also twice the values in FIG. 13A. A pulse duty cycle (a ratio between a pulse ON time and a pulse cycle) is not changed. The respective control parameters are set to the following values in advance.

Tpp=22.2E-6 (seconds)
Tpon=10.0E-6 (seconds)
Tbon1=1×Tpp=22.2E-6 (seconds)
Tbp1=Tbon1=22.2E-6 (seconds)
Tbp2=Tbon2=8×Tbon1=177.6E-6 (seconds)

As described with reference to FIGS. 5A to 5D, in a case where a frequency of an AC voltage applied to the energizing coil 3 is low, a heat generation distribution generally has a protrusion shape in which a heating value is great at the center in the longitudinal direction. Thus, in a case of using the waveform in FIG. 13B having a longer pulse cycle than that of the waveform in FIG. 13A, as illustrated in FIG. 13E, a heating value is great at the center of the fixing sleeve 1 in the longitudinal direction, and the heating value is small at both ends thereof.

FIGS. 13C to 13E illustrate examples of output waveforms in a case where a heating value level is reduced while a shape of a heat generation distribution in the longitudinal direction is maintained compared with FIG. 13B.

FIG. 13C illustrates an output waveform from the high frequency converter 16 corresponding to a heat generation distribution indicated by a dashed line (c) in FIG. 13F. The length Tpon of the pulse cycle is twice the length in FIG. 13A in the same manner as the length in FIG. 13B, and the length Tbp1 of the first burst cycle is three times the length in FIG. 13A. The respective control parameters are set to the following values in advance.

Tpp=22.2E-6 (seconds) (invariable)
Tpon=10.0E-6 (seconds) (invariable)
Tbon1=1×Tpp=33.3E-6 (seconds) (variable)
Tbp1=Tbon1=33.3E-6 (seconds) (variable)
Tbp2=Tbon2=8×Tbon1=266.4E-6 (seconds) (variable)

FIG. 13D illustrates the length Tbp1 of the first burst cycle larger than that in FIG. 13C. The respective control parameters are set to the following values in advance.

Tpp=22.2E-6 (seconds) (invariable)
Tpon=10.0E-6 (seconds) (invariable)
Tbp1=Tbon1=1×Tpp=44.4E-6 (seconds) (variable)
Tbp2=Tbon2=8×Tbon1=355.2E-6 (seconds) (variable)

FIG. 13E illustrates an output waveform from the high frequency converter 16 corresponding to a heat generation distribution indicated by a dashed line (e) in FIG. 13F, and illustrates the length Tbp2 of the second burst cycle larger than that in FIG. 13D. The respective control parameters are set to the following values in advance.

Tpp=22.2E-6 (seconds) (invariable)
Tpon=10.0E-6 (seconds) (invariable)
Tbp1=Tbon1=1×Tpp=44.4E-6 (seconds) (invariable)
Tbon2=8×Tbon1=355.2E-6 (seconds) (variable)
Tbp2=532.8E-6 (seconds) (variable)

It can be seen that the pulse cycle, the first burst cycle, and the second burst cycle are not included in a frequency band from 3 kHz to 20 kHz in any output waveform of FIGS. 13A to 13E. Therefore, it is possible to prevent the occurrence of a mosquito sound or vibration in the fixing sleeve 1 resulting in image quality deterioration by switching the output waveforms, and also to control the temperature of the fixing sleeve 1 while maintaining a desired heat generation distribution.

Figure 14:
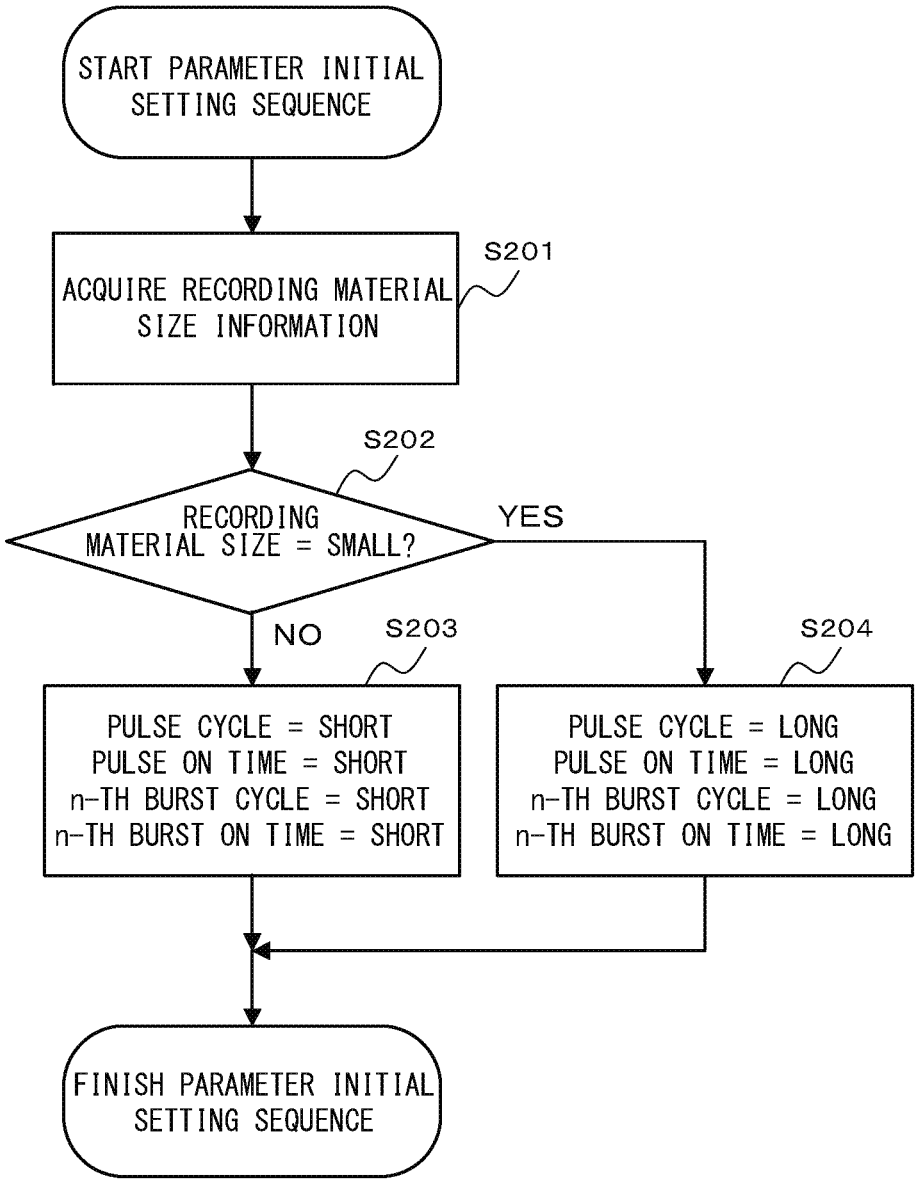
FIG. 14 is a flowchart illustrating procedures of initial setting of a control parameter of Example 3.

FIG. 14 is a flowchart illustrating initial setting of control parameters corresponding to a size of a recording material. Herein, it is assumed that the image forming apparatus 100 supports recording materials with two sizes. As an example, a size of a recording material with a large size is A4 size, and a size of a recording material with a small size is B5 size.

In a case where the image forming apparatus 100 is instructed to start an image forming operation on the basis of a print signal (not illustrated), a sequence in FIG. 14 is started. First, the power controller 15 reads information regarding a size of a recording material (S201), and determines whether or not a size of the recording material is a small size (B5) on the basis of the read size information (S202).

In a case of a recording material with a large size, a short time ("short") is set as an initial value of each control parameter (S203). Regarding the short time, herein, as illustrated in FIG. 13A, the pulse cycle is 11.1E-6 seconds, the pulse ON time is 5.0E-6 seconds, and the first burst cycle and the first output period are 11.1E-6 seconds. The second burst cycle and the second output period are 11.1E-6 seconds×8=88.8E-6 seconds.

In a case of a recording material with a small size, a long time ("long") is set as an initial value of each control parameter (S204). Regarding the long time, herein, as illustrated in FIG. 13B, the pulse cycle 20 is 22.2E-6 seconds, and the first burst cycle and the first output period are 22.2E-6 seconds. The second burst cycle and the second output period are 22.2E-6 seconds×8=177.6E-6 seconds.

In a case where the initial values of the control parameters are set, and then the temperature of the fixing sleeve 1 is controlled, a control method similar to that described in Example 1 may be performed. In this case, the output waveform control described with reference to FIG. 11 is performed according to a necessary heating value, and thus a specific frequency component is prevented from being included in a drive voltage. In a case where appropriate initial values (particularly, the pulse cycle) of control parameters corresponding to a recording material with a small size are set, it is possible to control a heating value of the fixing sleeve 1 while maintaining a shape of a heat generation distribution corresponding to a size of a recording material as illustrated in FIGS. 13B to 13E.

As mentioned above, according to the configuration of the present embodiment, it is possible to control a heating value with a simple configuration and also to prevent a problem due to a specific frequency component being included in a drive voltage. According to the configuration of the present embodiment, a heat generation distribution of a fixing rotary member in the longitudinal direction can be changed with a simple configuration, and it is possible to perform more appropriate temperature control corresponding to a size of a recording material or a temperature distribution of the rotary member.

In the present embodiment, a description will be made of a case where initial values of the control parameters are set according to a size of a recording material. Alternatively, values (particularly, the pulse cycle) of the control parameters may be changed according to detection results from the temperature detection elements 9 to 11 disposed at a plurality of positions in the longitudinal direction even in a case where a size of a recording material is constant.

Modification Example

In the above Examples 1 to 3, the fixing unit 100F mounted on the direct transfer type electrophotographic apparatus (FIG. 1) has been described, but the fixing unit 100F may be applied to an intermediate transfer type electrophotographic apparatus that transfers a toner image formed on a photosensitive member onto a recording material via an intermediate transfer member. The fixing unit 100F described in the above Examples 1 to 3 may be used as an image heating unit heating a toner image on a recording material. For example, the fixing unit 100F may be used as a unit fixing transparent toner that makes an image glossy onto a recording material or may be used as a unit adjusting fixing property and glossiness by heating again a toner image subjected to a previous fixing process.

In Examples 1 to 3, as an example of a tubular rotary member, the endless (that is, belt-like) fixing sleeve 1 using a flexible filmy material has been described, but a cylindrical roller with high stiffness may be used.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-125854, filed Jul. 5, 2019, which is hereby incorporated by reference herein in its entirety.

What is claimed is:

1. A fixing unit comprising:

a rotary member that is tubular and comprises a conductive layer;

a magnetic core inserted in the rotary member and extending in a longitudinal direction of the rotary member;

a coil wound around an outer circumference of the magnetic core;

a converter device configured to apply an AC voltage to the coil;

a temperature detection unit configured to detect a temperature of the rotary member; and a controller configured to control the converter device based on a detection result of the temperature detection unit such that the conductive layer is heated by induction heating and a toner image on a recording material coming into contact with the rotary member is heated to be fixed onto the recording material, wherein the controller is configured to cause the converter device to output a cyclic waveform in which a first waveform and a second waveform appear, the first waveform being a waveform in which pulses having a constant cycle are successively output for a first output period and output of the pulses is paused for a first pause period after the first output period, the second waveform being a waveform in which the first waveform is repeatedly output for a second output period and output of the first waveform is paused for a second pause period after the second output period, and the cyclic waveform being a waveform in which the second waveform is cyclically repeated as a repetition unit.

2. The fixing unit according to claim 1, wherein the controller is configured to set the first output period, the first pause period, the second output period, and the second pause period such that a cycle of the first waveform is shorter than a range of cycles corresponding to a predetermined frequency band, and a cycle of the second waveform is longer than the range of the cycles corresponding to the predetermined frequency band.

3. The fixing unit according to claim 2, wherein the predetermined frequency band is a frequency band of 3 kHz or higher and 20 kHz or lower.

4. The fixing unit according to claim 1, wherein the controller is configured to change a heating value of the rotary member by changing a length of the first output period.

5. The fixing unit according to claim 1, wherein the controller is configured to change a heating value of the rotary member by changing a length of the first pause period.

6. The fixing unit according to claim 1, wherein the controller is configured to change a heating value of the rotary member by changing a length of the second output period.

7. The fixing unit according to claim 1, wherein the controller is configured to change a heating value of the rotary member by changing a length of the second pause period.

8. The fixing unit according to claim 1, wherein controller is configured to execute a first mode of outputting a first cyclic waveform, in which the first waveform is cyclically repeated as a repetition unit, from the converter device and a second mode of outputting a second cyclic waveform, in which the second waveform is cyclically repeated as a repetition unit, from the converter device.

9. The fixing unit according to claim 8, wherein the controller is configured to execute a third mode of outputting a third cyclic waveform, in which a third waveform is cyclically repeated as a repetition unit, from the converter device, and wherein the third waveform is a waveform in which the second waveform is repeated for a third output period and output of the second waveform is paused for a third pause period after the third output period.

10. The fixing unit according to claim 1, wherein the controller is configured to change a distribution of a heating value of the conductive layer in the longitudinal direction of the rotary member by changing a pulse cycle in the first output period.

11. The fixing unit according to claim 10, wherein the controller is configured to change the distribution of the heating value of the conductive layer in the longitudinal direction of the rotary member according to a length of the recording material in the longitudinal direction of the rotary member.

12. The fixing unit according to claim 10, wherein the temperature detection unit comprises a first detection unit configured to detect a temperature of the rotary member at a predetermined position in the longitudinal direction of the rotary member and a second detection unit configured to detect a temperature of the rotary member outside the predetermined position in the longitudinal direction of the rotary member, and wherein the controller is configured to change the distribution of the heating value of the conductive layer in the longitudinal direction of the rotary member based on detection results of the first detection unit and the second detection unit.

13. The fixing unit according to claim 1, wherein the converter device comprises a rectification circuit configured to rectify an AC voltage supplied from a commercial power source and a full-bridge type inverter circuit connected to the rectification circuit, and is configured to output pulses including a positive half wave and a negative half wave having the same shape with each other.

14. The fixing unit according to claim 1, wherein the magnetic core is a rod-shaped member extending in the longitudinal direction of the rotary member and disposed inside the rotary member viewed in the longitudinal direction of the rotary member, the magnetic core being configured to form an open magnetic path such that a line of magnetic force does not pass through the magnetic core outside the rotary member, wherein a turning number of turns of the coil per unit length in the longitudinal direction of the rotary member differs in accordance with positions in the longitudinal direction of the rotary member, and wherein the magnetic core and the coil are formed such that, in a case where pulses with a predetermined pulse cycle are applied to the coil from the converter device, a distribution of a heating value of the conductive layer in the longitudinal direction of the rotary member is substantially uniform over a range in which the rotary member comes into contact with a recording material with a predetermined size.

15. An image forming apparatus comprising:

an image forming unit configured to form a toner image on a sheet; and the fixing unit according to claim 1, configured to fix the toner image formed on the sheet by the image forming unit onto the sheet.

* * * * *